United States Patent [19]

Peterson et al.

[11] Patent Number: 4,805,542

[45] Date of Patent: Feb. 21, 1989

[54] TABLE

[75] Inventors: Warren J. Peterson; Charles E. Warner; Peter J. Waldmann, all of Stevens Point, Wis.

[73] Assignee: Joerns Healthcare, Inc., Stevens Point, Wis.

[21] Appl. No.: 939,613

[22] Filed: Dec. 9, 1986

[51] Int. Cl.[4] ..... A47B 9/00

[52] U.S. Cl. ..... 108/150; 108/147; 16/34

[58] Field of Search ..... 108/147, 144, 27; 16/32, 33, 34; 312/250; 248/129, 916

[56] References Cited

U.S. PATENT DOCUMENTS

| | | | |
|---|---|---|---|
| D. 93,059 | 8/1934 | Walker . | |
| 120,550 | 10/1871 | Thornton . | |
| 124,106 | 2/1872 | Wright . | |
| 237,050 | 1/1881 | Ryder . | |
| 251,949 | 1/1882 | Risdon . | |
| 270,263 | 1/1883 | Tix . | |
| 274,605 | 3/1883 | Hormann . | |
| 901,636 | 10/1908 | McIntire . | |
| 922,565 | 5/1909 | Cole . | |
| 953,492 | 3/1910 | Sharon . | |
| 1,007,022 | 10/1911 | Doll . | |
| 1,016,324 | 2/1912 | Dunn . | |
| 1,019,302 | 3/1912 | Butcher . | |
| 1,022,646 | 4/1912 | Toll . | |
| 1,050,352 | 1/1913 | Deutschman . | |
| 1,076,778 | 10/1913 | Medart . | |
| 1,229,138 | 6/1917 | Reischmann . | |
| 1,689,626 | 10/1928 | Gallowitz . | |
| 1,792,673 | 2/1931 | Amstutz | 108/144 |
| 1,899,835 | 2/1933 | Thum . | |
| 2,065,952 | 12/1936 | Trautman | 108/147 X |
| 2,217,031 | 10/1940 | Sutton . | |
| 2,342,631 | 2/1944 | Hillenbrand | 108/147 |
| 2,418,514 | 4/1947 | Lamberson | 108/27 X |
| 2,490,953 | 12/1949 | Eriksen | 16/33 |
| 2,524,819 | 10/1950 | McKean . | |
| 2,553,939 | 5/1951 | Pivovaroff . | |
| 2,774,986 | 12/1956 | Moorehouse | 16/34 |
| 2,791,477 | 5/1957 | Wesbecher . | |
| 2,908,031 | 10/1959 | Millet et al. | 16/34 |
| 3,096,991 | 7/1963 | Crankshaw . | |
| 3,115,849 | 12/1963 | Johnson | 108/144 X |
| 3,358,620 | 12/1967 | Parigi . | |
| 3,517,625 | 6/1970 | Swett . | |
| 3,525,492 | 8/1970 | Friedman et al. . | |
| 3,685,851 | 8/1972 | Berry . | |
| 3,707,930 | 1/1973 | Yindra et al. | 108/147 |
| 3,869,106 | 3/1975 | Gregov . | |
| 3,968,755 | 7/1976 | Lester . | |
| 3,993,004 | 11/1976 | Alme . | |
| 4,008,507 | 2/1977 | Smith | 16/39 |
| 4,053,129 | 10/1977 | Graff . | |
| 4,108,455 | 8/1978 | James . | |
| 4,269,096 | 5/1981 | Boone . | |
| 4,301,745 | 11/1981 | Dale . | |
| 4,339,842 | 7/1982 | Fontana et al. . | |
| 4,352,479 | 10/1982 | Chapman, Jr. . | |
| 4,364,148 | 12/1982 | McVicker . | |
| 4,420,168 | 12/1983 | Dewing . | |
| 4,503,780 | 3/1985 | Apissomian . | |
| 4,515,087 | 5/1985 | Kurrasch . | |
| 4,570,410 | 2/1986 | Tuneke et al. . | |
| 4,570,547 | 2/1986 | Colby . | |

*Primary Examiner*—Peter A. Aschenbrenner
*Attorney, Agent, or Firm*—Price, Heneveld, Cooper, DeWitt & Litton

[57] ABSTRACT

A table is provided with a single retractable caster to facilitate manually transporting the table from one location to another. The retractable caster is located substantially directly below the center of gravity of the table, so that when the caster is extended to an "on" position, the table can be held in a generally poised condition over the caster wheel, and manually rolled across the floor. A pedestal-type base, having radially outwardly extending feet with glides provides outrigger support for the table during transport. The caster is shifted between the extended "on" position, and a retracted "off" position by simply tilting the table slightly about its base, such that a person having ordinary strength and dexterity can easily and safely move the table about a room without assistance. An institutional version of the table is designed for use in hospitals, nursing homes, and the like, and may include a vertically adjustable top to accommodate both ambulatory and wheelchair patients, as well as a raised, marginal, top edge that forms a spill guard with contrasting colors to facilitate use by the visually impaired.

34 Claims, 11 Drawing Sheets

FIG. 1
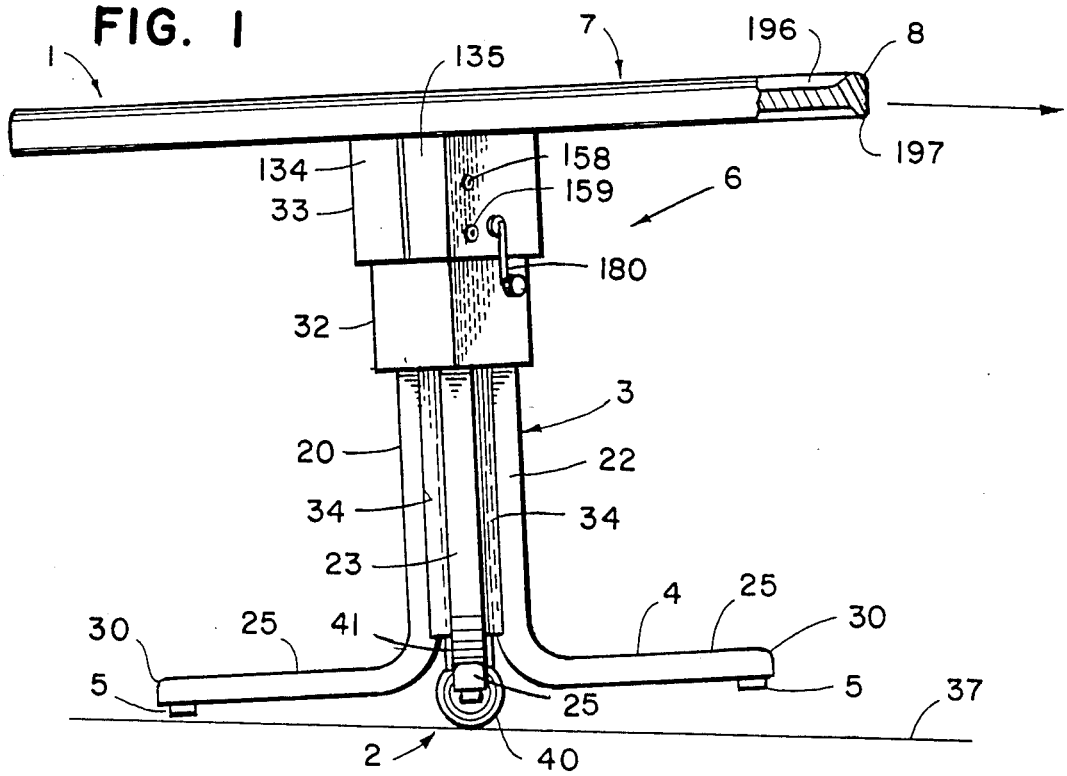
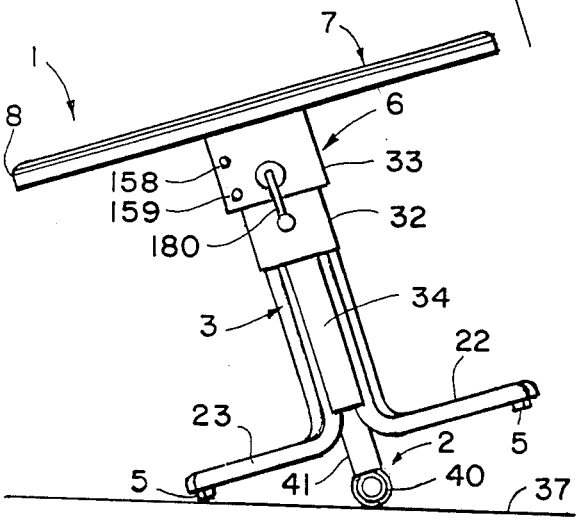
FIG. 2
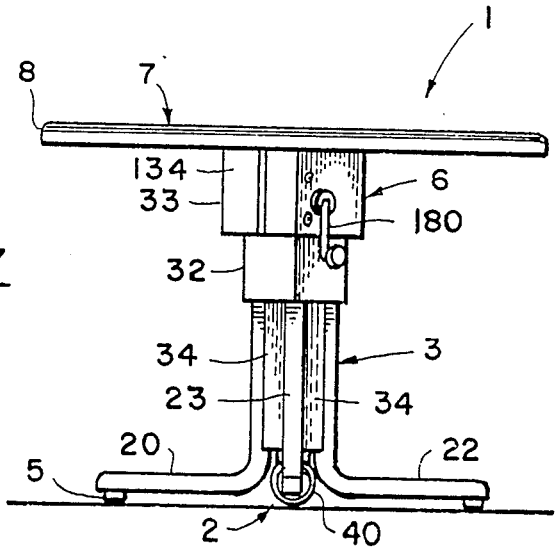
FIG. 3

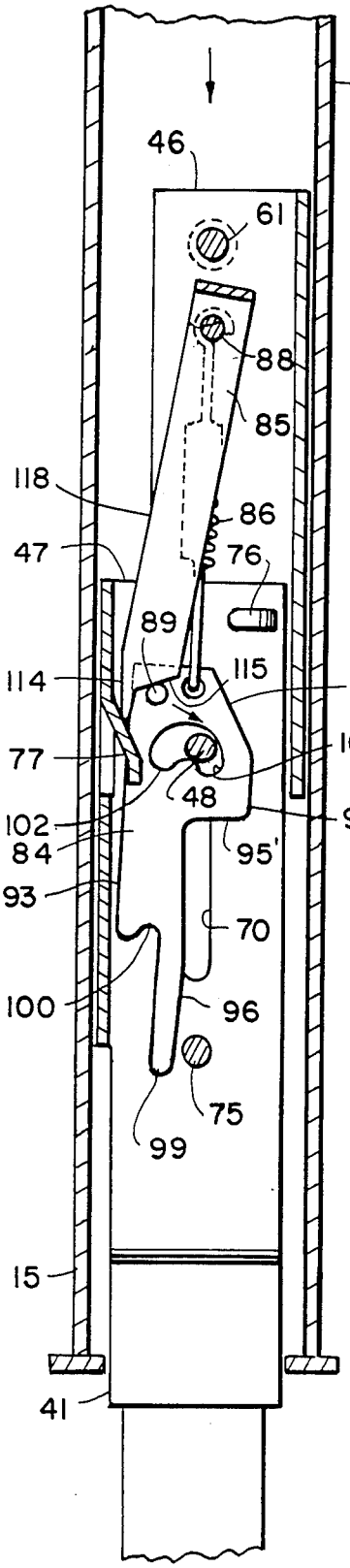
FIG. 20
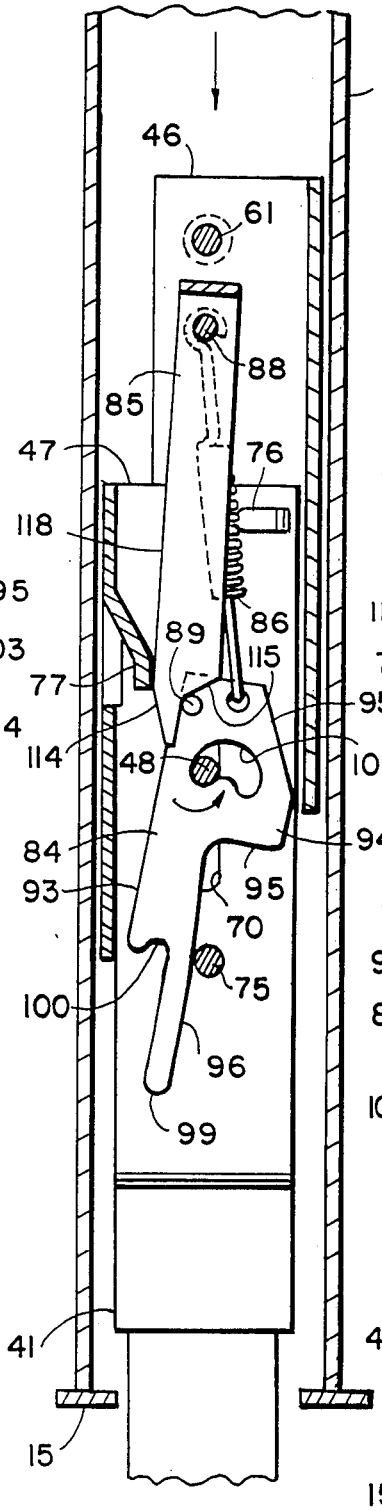
FIG. 21
FIG. 22
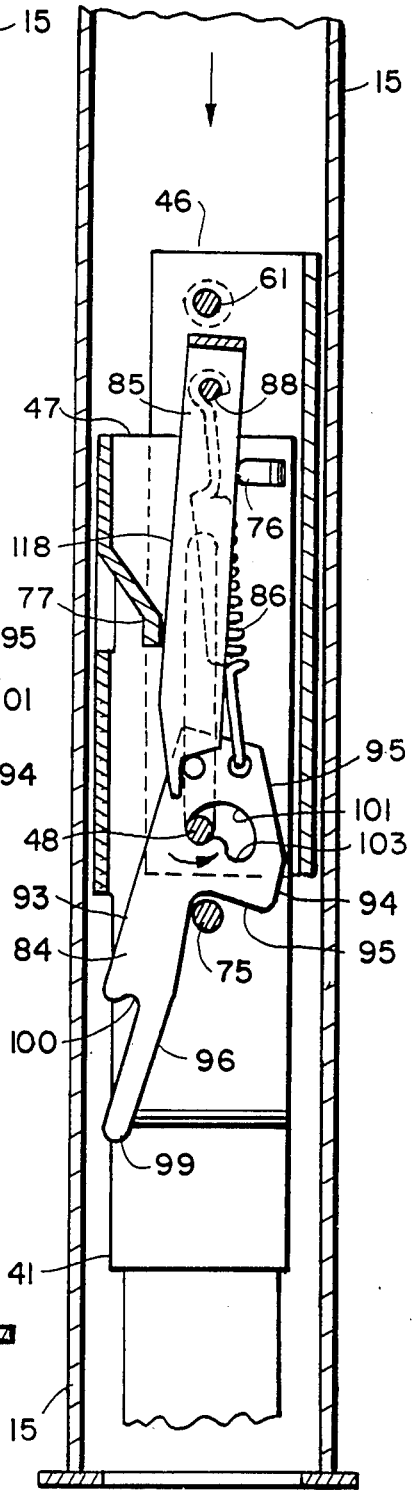

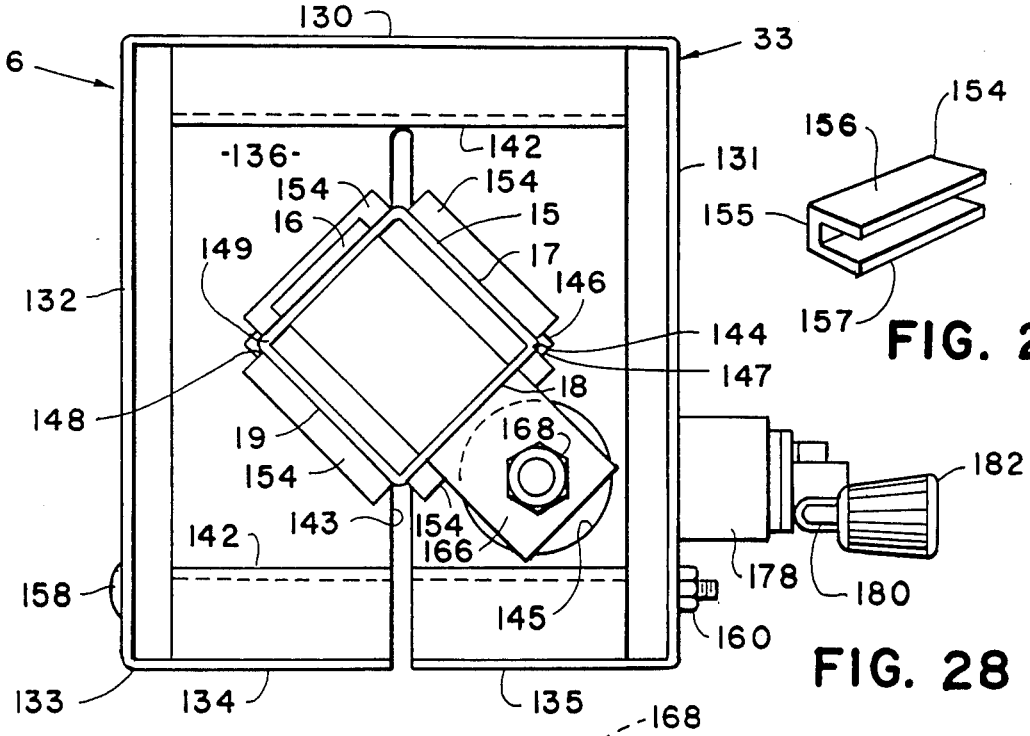
FIG. 29
FIG. 28
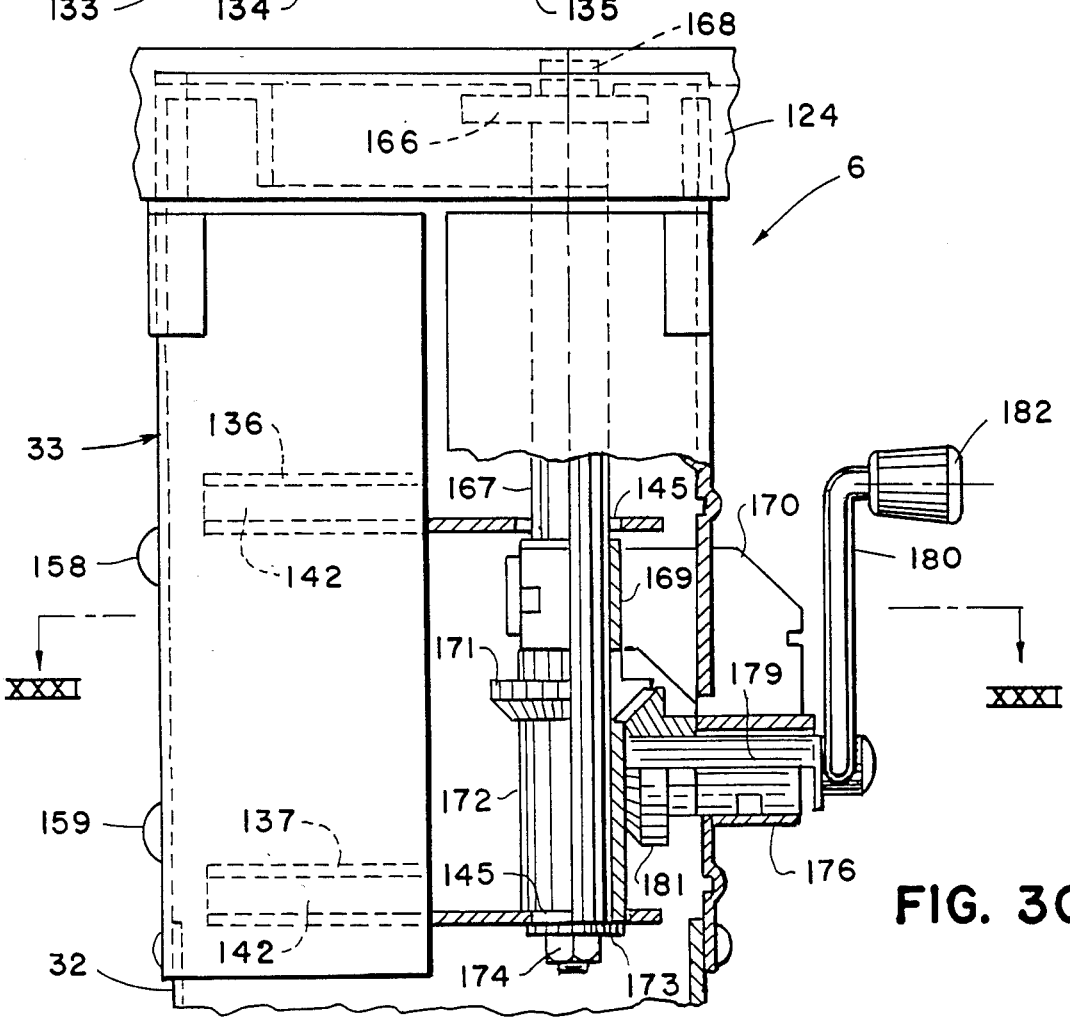
FIG. 30

TABLE

BACKGROUND OF THE INVENTION

The present invention relates to tables and the like, and in particular to a portable table that is especially adapted for institutional settings, such as in hospitals, schools, general dining halls, nursing homes, and the like.

Tables are employed in institutional environments for a wide variety of different uses, including dining, games, crafts, and other well known functions. Such tables are normally situated in large, open rooms, which often function for multiple purposes, including dining, gathering, entertaining, et cetera.

To facilitate such multipurpose rooms, it is important that institutional type tables be capable of being easily transported from one location to another to rearrange or store the furniture in the room for different purposes and events. Preferably, institutional tables can be manually transported between locations by a single person of average strength and dexterity with relative ease and safety.

In health care institutions, such as hospitals, nursing homes, and the like, which have patients in wheelchairs, geriatric chairs, and other similar special purpose seats, separate tables are normally provided to accommodate the additional height needed for the chair stricken resident. However, the use of special wheelchair tables tends to segregate patients, preventing friends and acquaintances from sitting at the same table. Although some types of fixed height tables are provided with cutout areas in the apron to accommodate wheelchairs, their height is typically at a compromise level that is not entirely satisfactory or comfortable for either the wheelchair patient or the ambulatory resident. Some table tops have even been suspended from the ceiling to accommodate wheelchair patients However, such arrangements are quite costly to produce and install, and are still not adjustable to accommodate all types of users.

Hence, it is preferable that institutional tables have some type of mechanism to adjust the height of the top, so that the table can accommodate all types of users. The top adjustment should provide very secure support, yet be such that one person can easily raise and lower the table top, even with food and beverages on the table. Such a high-low adjustment feature would permit residents in wheelchairs and geriatric chairs to be seated with friends in conventional chairs at any table they desire in the room. Although high-low adjustment mechanisms have been used on some types of horizontal supports, they are typically quite complex in construction and/or do not provide good stable support for the top.

Another problem experienced wit institutional tables, particularly in geriatric settings, is that liquids often spill and adhere to the underside of the top, thereby creating a substantial housekeeping problem. Further, the edges of such tables are normally rather sharp, and therefore tend to restrict blood circulation in the arms of elderly users as they press down on the table. The inability of patients with impaired vision to accurately locate the edge of the table top also contributes to inadvertent spills, and hinders safely entering and exiting seats located adjacent to the table.

SUMMARY OF THE INVENTION

One aspect of the present invention is to provide a portable table that can be easily transported from one location to another. The table comprises a top shaped to selectively support articles thereon, and a base having an upper end thereof operably connected with the top, and a lower end adapted to support the top at a preselected height above a floor, or other support surface. The table includes a retractable caster, having a ground engaging wheel with means for shifting the wheel between an extended position wherein the caster wheel is weight-bearing, and supports the table on the support surface, and a retracted position wherein the wheel is not weight-bearing, and the base supports the table on the support surface. The retractable caster is connected with the table at a location selected so that the caster wheel is disposed substantially directly below the center of gravity of the table when the caster is in the extended position, whereby the table can be easily transported from one location to another by shifting the caster wheel to the extended position, positioning the table in a generally poised condition over the caster wheel, and manually translating the table in the generally poised condition over the support surface.

Preferably, the base includes at least three glide surfaces that are spaced radially outwardly from the pedestal, and are mutually spaced apart circumferentially to provide outrigger support for the table during transport Also, the caster is preferably shifted between "on" and "off" positions by simply tilting the table about its base.

Another aspect of the present invention is a high-low adjustment feature for tables, comprising a collar operably connected with the top, and slidingly supported on a pedestal portion of the base for vertical movement therealong. A screw having an upper end thereof connected with the pedestal extends generally parallel therewith, and a nut is carried on the collar and threadedly engages the screw, such that selective rotation of the nut with respect to the screw raises and lowers the top. A split collar provides secure, adjustable top support, without a complicated construction.

Another aspect of the present invention is a raised, contoured edge construction for tables, wherein the top comprises a rigid panel having an upper surface with a preselected coloration to abuttingly support articles thereon. The marginal edge of the top is raised above the level of the support surface to form a spill guard, and has a coloration contrasting to the coloration of the support surface to facilitate use by visually impaired users.

Yet another aspect of the present invention is a pedestal base construction for tables and the like, comprising a rigid tubular support having at least three oppositely oriented exterior faces. At least three legs, each having a generally L-shaped side elevational configuration are attached to the faces of the support pedestal, such that the legs extend radially outwardly from the support pedestal in a circumferentially spaced apart pattern to securely support the top thereon. The base provides unobstructed access to the table from all sides, and has a neat, sleek appearance.

The principal objects of the present invention are to provide a table having a single, retractable, center caster that permits a person of ordinary strength and dexterity to easily and safely move the table without assistance. The table may be adapted for all types of uses, including dining, games, studying, as well as general table use. The table has a base with spaced apart glides that provide outrigger support during transport. The caster is extended and retracted by simply tilting the table about its base, so that the caster can be activated from a comfortable, upright position to avoid stooping and bending. Furthermore, the table can be grasped for transport from any side thereof, and by mounting the retractable caster within a center pedestal portion of the table, improved strength, operation and appearance is achieved.

A high-low adjustment mechanism is provided for the top to vertically adjust the table top to accommodate both chair stricken residents and patients that can sit in conventional seats. The high-low adjustment mechanism is uncomplicated, yet provides very stable top support, even when the top is being raised and lowered.

A special top configuration includes a raised and rounded marginal edge that forms a spill guard. The edge is shaped to form a continuous handle to grasp the table for transport, and is rounded to provide a friendly surface, that is less traumatic on capillary blood flow and the delicate skin on elderly forearms The raised and rounded edge of the table top also assists people in entering and exiting seats disposed adjacent to the table, because it is easy to grasp. A contrasting color band on the edge of the top makes it easy for people with poor or failing eyesight to accurately locate the edge of the table top to alleviate spills and save housekeeping labor.

A four leg pedestal base makes the table very stable, even when a person leans on the edge of the table. Furthermore, the pedestal base construction allows unobstructed access from all sides of the table.

The table is efficient in use, economical to manufacture, capable of a long operating life, and particularly well adapted for the proposed use These and other features, advantages and objects of the present invention will be further understood and appreciated by those skilled in the art by reference to the following written specification, claims and appended drawings.

BRIEF DESCRIPTION OF THE DRAWINGS

FIG. 1 is a front elevational view of a table embodying the present invention, shown with a retractable caster portion of the invention in an "on" position, and the table being transported across a support surface.

FIG. 2 is a side elevational view of the table, shown in a tilted position to shift the retractable caster to an "off" position.

FIG. 3 is a front elevational view of the table, shown with the caster in the "off" position.

FIG. 20 (sheet No. 7) is a vertical cross-sectional view of the caster actuator, shown in the position assumed when the table is lowered slightly from the fully extended position.

FIG. 21 is a vertical cross-sectional view of the caster actuator, shown in the position assumed when the table is lowered further from the position illustrate in FIG. 20, with the latch pawl shifted back into the counterclockwise biased position.

FIG. 22 is a vertical cross-sectional view of the caster actuator shown in the position assumed when the table is lowered further from the position illustrated in FIG. 21 to the caster in the fully retracted, "off" position.

FIG. 28 is a top plan view of the high-low mechanism.

FIG. 29 is a perspective view of a glide portion of the high-low mechanism.

FIG. 30 is a front elevational view of the high-low mechanism, wherein portions thereof have been broken away to reveal internal construction.

DETAILED DESCRIPTION OF THE PREFERRED EMBODIMENTS

Figure 4:
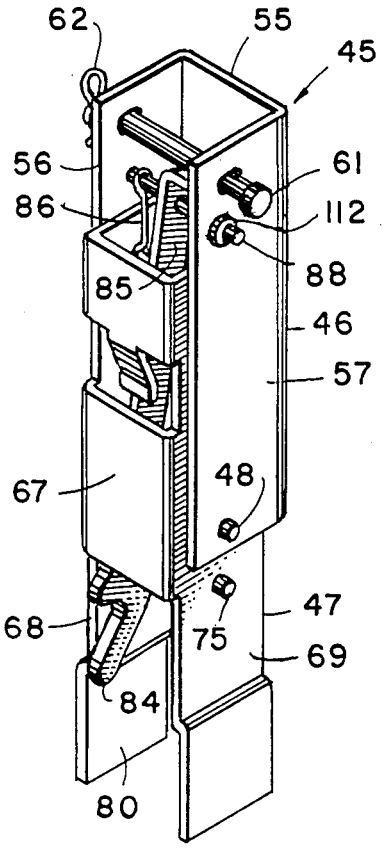
FIG. 4 is a perspective view of a caster actuator portion of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a table embodying the present invention. Table 1 includes a retractable caster assembly 2 to facilitate manually transporting table 1 from one location to another. Retractable caster 2 is located substantially directly below the center of gravity of table 1, so that when retractable caster 2 is extended to the "on" position illustrated in FIG. 1, table 1 can be held in a generally poised condition over retractable caster 2, and manually rolled across the floor. A pedestal-type base 3, having radially outwardly extending feet 4 with glides 5 provides outrigger support for table 1 during transport In the illustrated table 1, retractable caster 2 is shifted between the extended "on" position illustrated in FIG. 1, and a retracted "off" position illustrated in FIG. 3 by simply tilting table 1 on or about its base in the manner illustrated in FIG. 2, such that a person of ordinary strength and dexterity can easily and safely move table 1 about the room without assistance.

The illustrated table 1 is an institutional version of the present invention, and is particularly designed for use in hospitals, nursing homes, and the like, and includes a high-low adjustment mechanism 6 connecting top 7 to base 3 to accommodate wheelchair patients, and a raised marginal edge 8 that forms a spill guard, with a contrasting color to facilitate use by the visually impaired.

Figure 24:
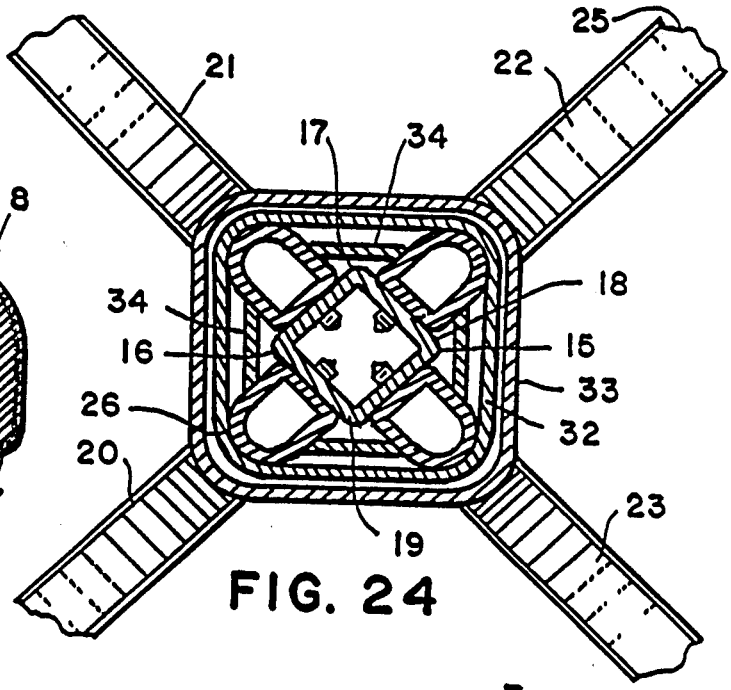
FIG. 24 is a horizontal cross-sectional view of a pedestal base portion of the table, taken along the line XXIV—XXIV of FIG. 25.
Figure 25:
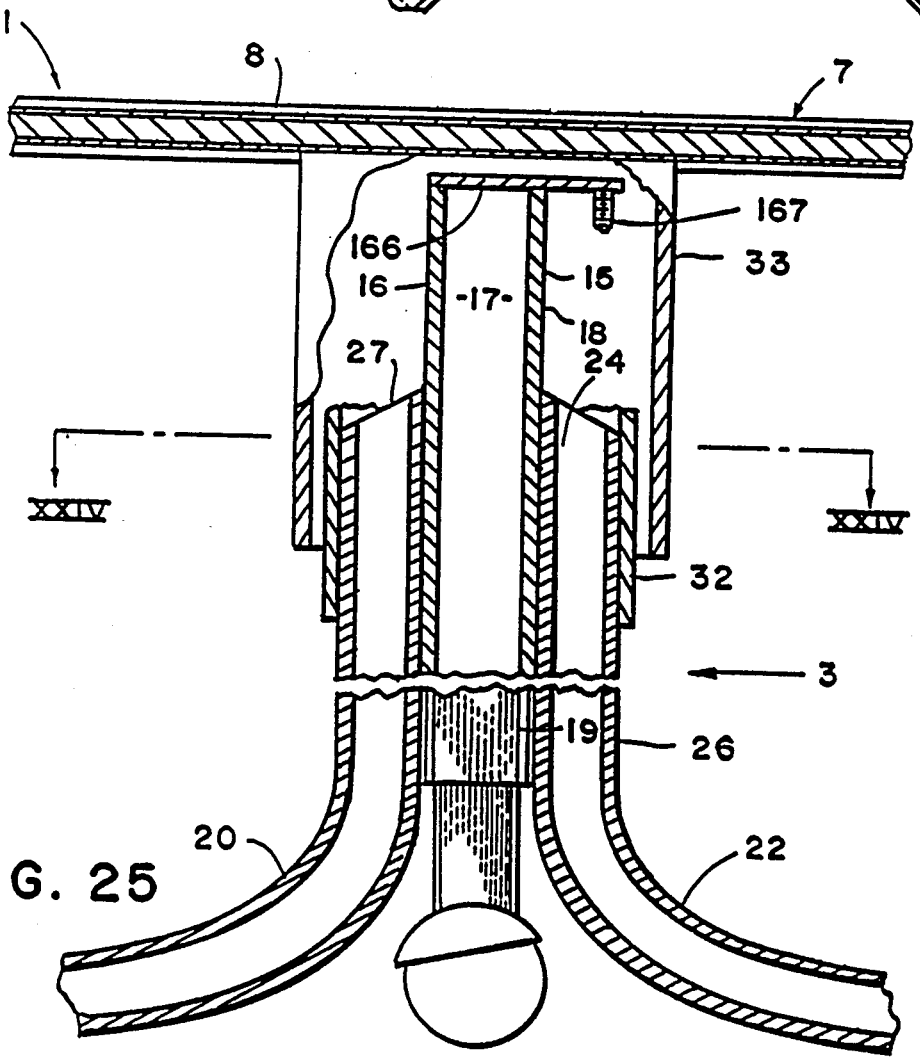
FIG. 25 is a fragmentary vertical cross-sectional view of the table pedestal.

With reference to FIGS. 24 and 25, base 3 comprises a tubular center column 15 which, in this example, has a substantially square transverse cross-sectional shape, with side faces 16–19. Center column 15 is hollow, and the lower end thereof is open to receive retractable caster assembly 2 therein in the manner described below. Base 3 also includes four tubular legs 20–23, each of which has a generally L-shaped side elevational configuration, with upper and lower ends 24 and 25 respectively. In the illustrated example, legs 20–23 have a rounded, generally U-shaped exterior surface 26, and upper terminal edges 27 that taper downwardly and outwardly. Legs 20–23 are attached to the side faces 16–19 respectively of center column 15 by suitable connecting means, such as welding, or mating U-shaped mounting channels with through bolts (not shown). Preferably, legs 20–23 are attached to center column 15 in a manner that keeps the interior of column 15 clear or unobstructed. A square, tubular shroud or housing 32 is attached to the upper ends 24 of legs 20–23, and forms an enclosure about the same. Housing 32 is telescopically received within a mating housing member 33 attached to table top 7, as described hereinafter, and forms a part of high-low adjuster 6. Four cover strips 34 are attached to and extend diagonally between adjacent legs 20–23. Cover strips 34 extend between medial portions of legs 20–23, and serve to create a neat, sleek appearance for pedestal base 3. It is to be understood that pedestal base 3 may be used interchangeably in conjunction with a fixed top height version of the present invention (not shown), as well as the illustrated adjustable high-low top height arrangement.

As best illustrated in FIGS. 1–3, glides 5 are located on the lower ends 24 of legs 20–23, adjacent rounded terminal edges 30 thereof, and cooperate with retractable caster 2 to facilitate transporting the table from one location to another, as discussed in greater detail hereinafter. Glides 5 are preferably constructed from a rigid, antifriction material, such as nylon, or other hard plastics, to facilitate sliding abutment with the surface of floor 37. When retractable caster assembly 2 is in the "on" position, and table 1 is centered vertically and poised thereover, glides 5 are positioned so that they do not engage the floor 37. Glides 5 may be self leveling to facilitate use on uneven floors.

Retractable caster assembly 2 (FIGS. 1–3) includes a ground engaging caster wheel 40 adapted to rollingly support table 1 on the floor 37 or similar support surface. Caster wheel 40 is mounted in the lower end of an inner tube or center leg 41, which translates vertically in pedestal base 3 when caster wheel 40 is shifted between the "on" and "off" positions illustrated in FIGS. 1 and 3 respectively. The upper end of center leg 41 is connected with a caster actuator 45 (FIGS. 4–6) which shifts retractable caster 2 between the "on" and "off" positions by tilting table 1 on legs 20–23. Caster wheel 40 (FIGS. 1–3) has a substantially conventional construction, and is mounted by a pintle (not shown) rotatably received in a socket 43 (FIG. 10) in center leg 41, so as to pivot about a generally vertical axis to facilitate moving table 1 in any direction. Caster wheel 40 may be in the form of a disc-shaped wheel, or the illustrated ball caster, and is shown mounted in center leg 41 by a pin 44.

It is to be understood that the present invention contemplates use with various center glide arrangements, other than the illustrated caster wheel 40, which can be activated to facilitate manually transporting table 1 across a support surface. For instance, a sled shaped foot (not shown) with a smooth, antifriction lower surface may be suitable to transport table 1 over some types of floor surfaces. Other antifriction arrangements, such as ball bearing pads, multiple wheel supports, air cushions, and the like, can also be used to achieve the desired manual translation of table 1 by a single person of average strength and dexterity, which is contemplated by the present invention.

Caster actuator 45 (FIGS. 4–6) comprises an inner channel 46 connected with center column 15, and an intermediate channel 47 connected with center leg 41. Inner channel 46 and intermediate channel 47 are slidingly interconnected by a pin 48 in a manner that permits the same to translate longitudinally with respect to each other, as described in greater detail hereinafter. A latch assembly 49 selectively retains inner channel 46 and intermediate channel 47 in an extended, caster "on" position.

Figure 5:
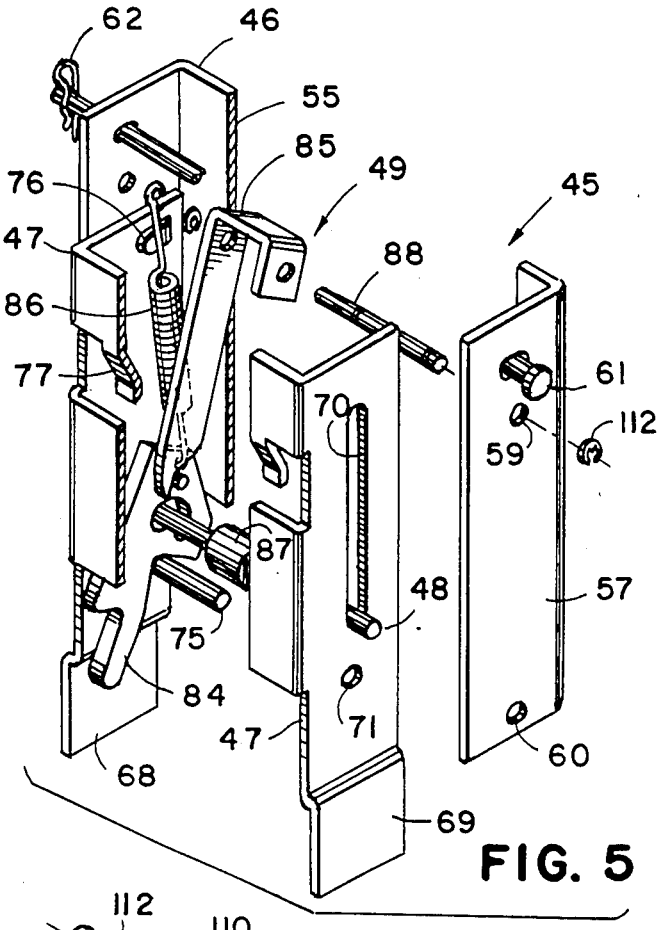
FIG. 5 is a partially exploded, perspective view of the caster actuator.
Figure 6:
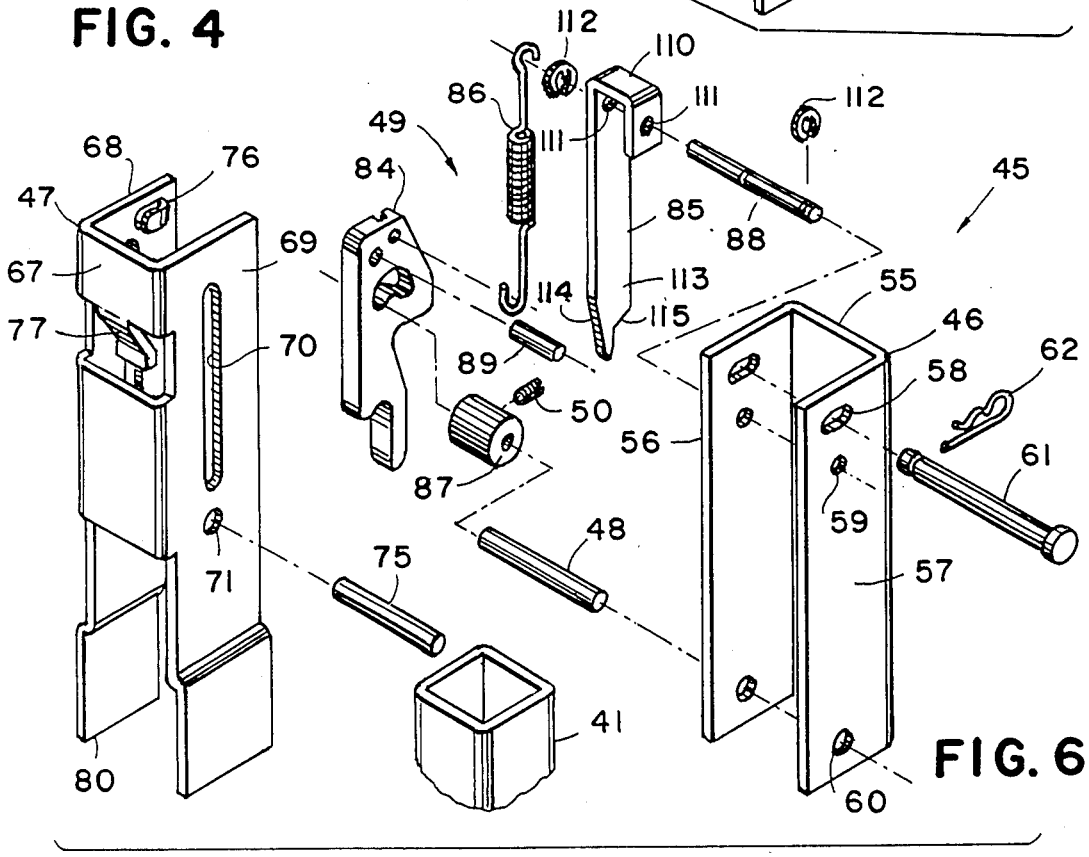
FIG. 6 is a fully exploded, perspective view of the caster actuator.
Figure 9:
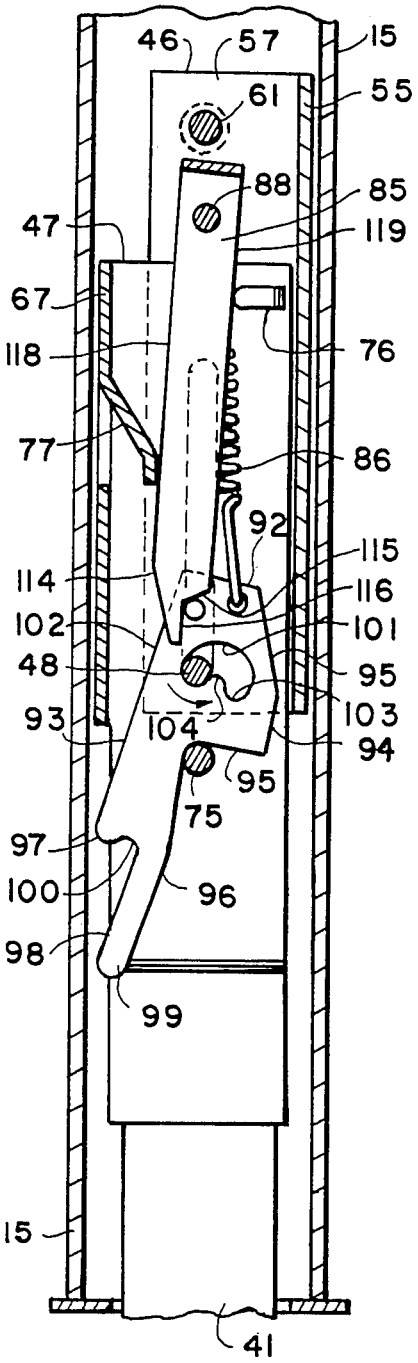
FIG. 9 is a vertical cross-sectional view of the caster actuator, shown with the caster in the "off" position.

Inner channel 46 (FIGS. 4–6) comprises a rigid U-shaped member, with a center web 55 and opposite flanges 56 and 57. Channel flanges 56 and 57 include three pairs of laterally aligned apertures 58, 59 and 60 respectively. A connecting pin 48 extends through flange apertures 60, and is retained in position between channel flanges 56 and 57 by suitable means, such as the illustrated set screw 50, in the manner described in detail below. Inner channel 46 is closely received within center column 15, as shown in FIG. 9, and is mounted therein by a clevis pin 61, which extends through flange apertures 58 (FIGS. 4–6). A cotter pin 62 is disposed through the smaller end of clevis pin 61 to retain the same in place.

Intermediate channel 47 (FIGS. 4–6) also has a U-shaped construction, comprising a web 67 and opposite flanges 68 and 69. Channel flanges 68 and 69 include a pair of laterally aligned, elongate slots 70 and apertures 71. As best illustrated in FIG. 4, the flanges 68 and 69 of intermediate channel 47 are shaped and spaced apart so that they are closely received between the flanges 56 and 57 of inner channel 46. Connector pin 48, which has its ends fixedly mounted in the flange apertures 60 of inner channel 46, extends through the flange slots 70 in intermediate channel 47, thereby permitting inner channel 46 and intermediate channel 47 to slide longitudinally with respect to each other along the length of slots 70.

Intermediate channel 47 (FIGS. 4–6) also includes a support pin 75 extending through flange apertures 71, and fixedly mounted to channel flanges 68 and 69 by suitable fastening means, such as a tack weld, or the like. A tab 76 is formed on channel flange 68, and protrudes inwardly therefrom. A tongue-shaped ramp 77 is formed on channel web 67, adjacent the upper end of intermediate channel 47, and also protrudes inwardly therefrom. Support pin 75, tab 76, and ramp 77 cooperate with latch assembly 49 in the manner discussed below to shift caster wheel 40 between the "on" and "off" positions. The web 67 at the lower end of intermediate channel 47 is cut away, and the associated portions of channel flanges 68 and 69 are bent outwardly so as to form a socket 80 in which the upper portion of center leg 41 is received and retained.

Figure 7:
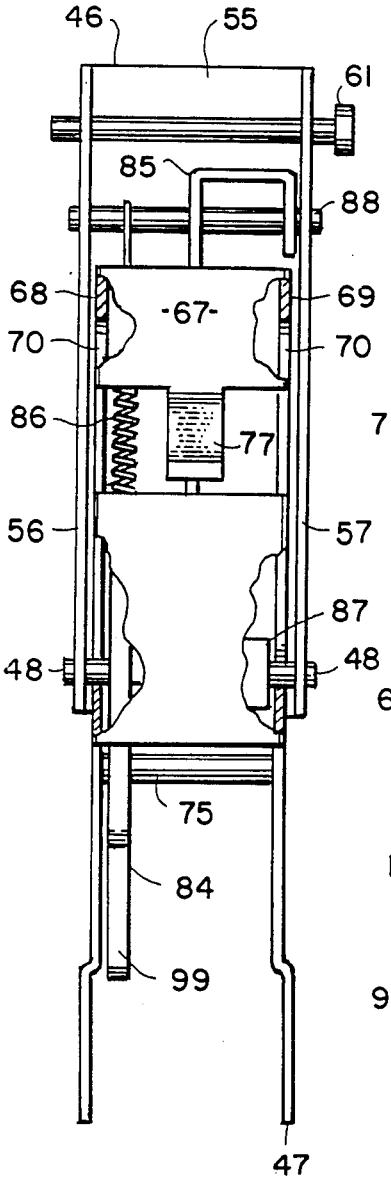
FIG. 7 is a front elevational view of the caster actuator, wherein portions thereof have been broken away to reveal internal construction.
Figure 8:
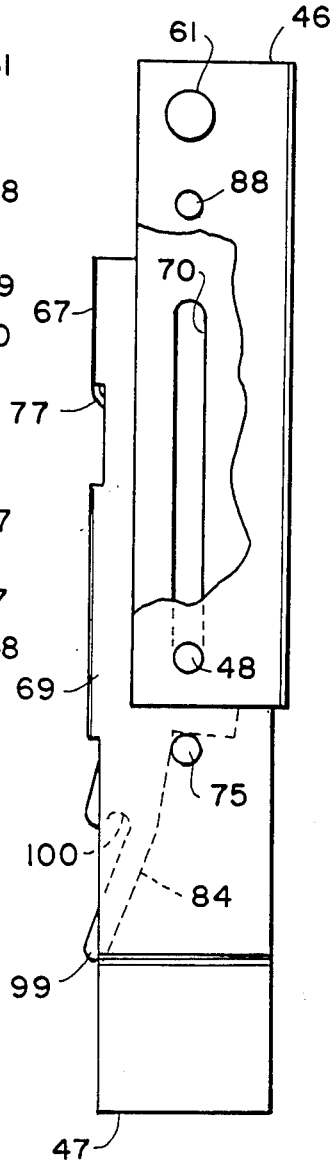
FIG. 8 is a side elevational view of the caster actuator, wherein portions thereof have been broken away to reveal internal construction.

As best illustrated in FIG. 6, latch assembly 49 comprises a pawl 84, a lever 85, a coil spring 86, a spacer 87, and pins 88 and 89. Pawl 84 has an irregular plan configuration, comprising a generally horizontally extending upper edge 92 (FIGS. 7–9), generally vertically extending side edges 93 and 94, a beveled upper edge 95, and two hook-shaped portions defined by intersecting lower edges 95 and 96, and 97 and 98 respectively. The lowermost end of pawl 84 defines a finger-shaped portion 99 disposed between side edges 96 and 98. Pawl edge 97 is curved in a double semicircular configuration to define a pocket 100 in which support pin 75 is selectively received in the caster "on" position, as described below. The upper end of pawl 84 includes a heart-shaped aperture 101, comprising a left-hand socket 102, a right-hand socket 103, and a lobe 104 extending therebetween. Connector pin 48, which has its opposite ends fixedly attached to the flanges 56 and 57 of inner channel 46 extends through the heart-shaped aperture 101 in pawl 84, thereby pivotally supporting pawl 84 on connector pin 48. Connector pin 48 has an outside diameter shaped to be closely received in the sockets 102 and 103 of heart-shaped aperture 101. Spacer 87 is also mounted on connector pin 48, and retains pawl 84 on that side of connector pin 48 adjacent to channel flange 56, which corresponds to the left-hand side of pin 48 as viewed in FIGS. 4–7. Set screw 50 is received through a threaded, radially extending aperture in spacer 87, and engages connector pin 48 to releasably interconnect spacer 87 and connector pin 48, and retain connector pin 48 in place in inner channel 46. Pin 89 is mounted in a mating aperture at the upper end of pawl 84, adjacent the intersection of pawl edges 92 and 93. The upper end of pawl 84 also includes a through aperture 105, disposed laterally opposite pin 89, which is shaped to receive the lower end of spring 86 therein.

Figure 10:
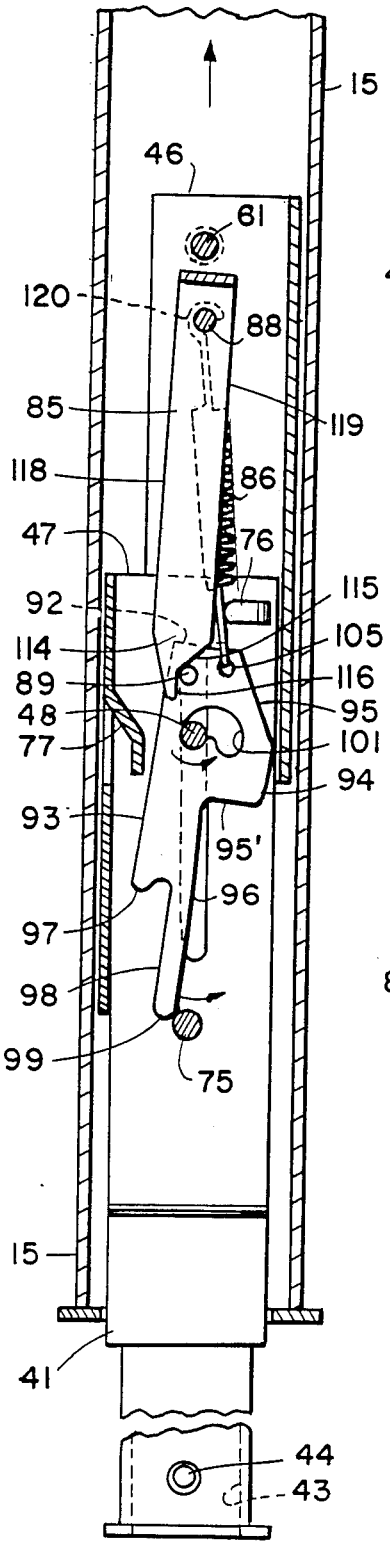
FIG. 10 is a vertical cross-sectional view of the caster actuator, shown in the position assumed when the table is raised slightly from the caster "off" position toward the caster "on" position.
Figure 18:
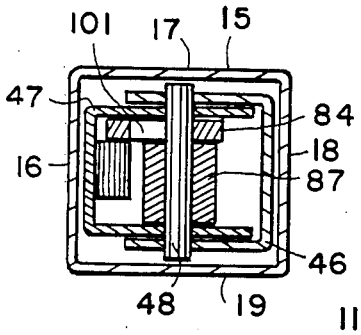
FIG. 18 (sheet No. 4) is a lateral cross-sectional view of the caster actuator, taken along the line XVIII—XVIII of FIG. 16.
Figure 19:
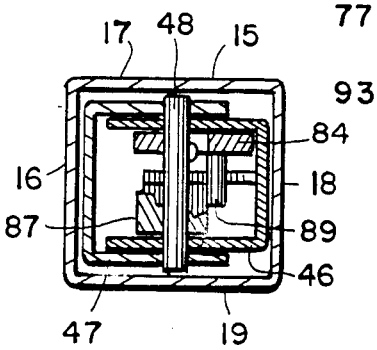
FIG. 19 (sheet No. 4) is a lateral cross-sectional view of the caster actuator, taken along the line XIX—XIX of FIG. 16.
Figure 11:
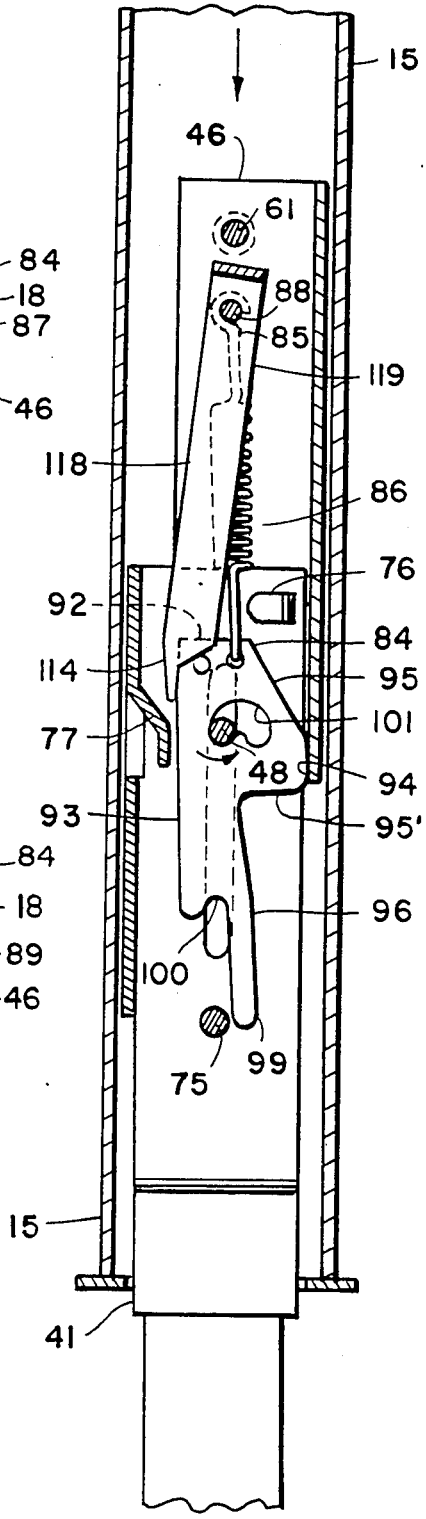
FIG. 11 is a vertical cross-sectional view of the caster actuator, shown in the position assumed when the table has been raised slightly, and then lowered from the position shown in FIG. 10 toward the caster "on" position.

Lever 85 (FIGS. 4–6) has a U-shaped upper end 110, with laterally aligned apertures 111 therethrough. Lever pin 88 extends through the flange apertures 59 in inner channel 46, and through apertures 111 in the upper end 110 of lever 85, so as to pivotally mount lever 85 in inner channel 46. Lever pin 88 is retained in place by suitable means, such as the illustrated snap rings 112. Lever 85 includes parallel side edges 118 and 119, and a generally pointed or tapered lower end, comprising intersecting edges 114–116 (FIGS. 10–11). Lever edge 114 is beveled with respect to side edge 118, so as to facilitate engagement with ramp 77. Lever edges 115 is disposed substantially parallel with side edges 118 and 119, and lever edge 115 is inclined with respect to side edge 119 to form a cam surface that abuts and rides against pawl pin 89 to shift pawl 84 both vertically and laterally, in the manner discussed in greater detail below. The upper end 120 of spring 86 is connected with pin 88, and is disposed laterally between lever 85, and flange 56 of inner channel 46. Spring 86 is pretensed so as to apply biasing force to pawl 84.

With reference to FIGS. 9–22, latch assembly 49 operates in the following manner to shift caster wheel 40 between the "on" and "off" positions by tilting table 1 on feet 4 in any direction. When retractable caster 2 is in the "off" position, as illustrated in FIG. 9, inner channel 46 and intermediate channel 47 are nearly fully converged, with connector pin 48 positioned toward the lower ends of slots 70. Support pin 75 is disposed in the cut away, lower portion of pawl 84, defined by edges 95 and 96. It is to be noted that in the caster "off" position connector pin 48 does not engage the lower ends of slots 70, such that caster wheel 40 can "float" vertically either upwardly or downwardly. This feature permits proper functioning of retractable caster 2, even when the floor 37 is very uneven. In the caster "off" position, retractable caster 2 is not weight-bearing, such that the feet 4 of pedestal base 3 support all of the weight of table 1. In the caster "off" position shown in FIG. 9, pawl 84 is rotated in a slightly counterclockwise direction from vertical, with connector pin 48 disposed in the left-hand socket 102 of heart-shaped aperture 101. Because connector pin 48 is located in the left-hand socket 102 of pawl 84, spring 86 applies a counterclockwise torque to pawl 84 about connector pin 48 in the direction of the curved arrow shown in FIG. 9. Contact between lower edge 96 of pawl 84 and support pin 75 prevents pawl 84 from rotating into an equilibrium position. Contact between the left-hand edge 118 of lever 85 and ramp 77 prevents pawl 84 from shifting laterally on connector pin 48 to the right-hand socket 103.

Figure 12:
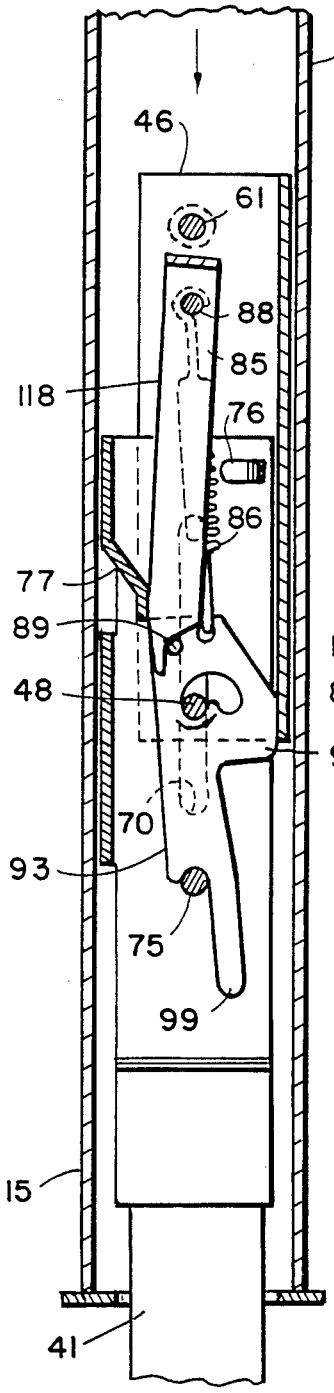
FIG. 12 is a vertical cross-sectional view of the caster actuator, shown in the caster "on" position.

To shift retractable caster 2 from the "off" position illustrated in FIGS. 3 and 9 to the "on" position illustrated in FIGS. 1 and 12, the user grasps the marginal edge 8 of table top 7 and tilts table 1 laterally on feet 4 in any direction, thereby raising center column 15 and connected inner channel 46 with respect to the floor 37. In the illustrated four-leg embodiment of base 3, table 1 is normally tilted on or about two of the four legs 20–23, as illustrated in FIG. 2. The weight of retractable caster assembly 2 causes caster wheel 40 to remain in abutting contact with the floor 37 as table 1 is tilted. The initial stages of this lifting action are illustrated in FIG. 10, wherein inner channel 46 has been diverged from intermediate channel 47 to the extent that lever 85 is raised above ramp 77, so as to permit pawl 85 to rotate on connector pin 48. As the terminal end of the pawl finger 99 passes over the exterior surface of support pin 75, the resilient force of spring 86 rotates pawl 84 in a counterclockwise direction to a generally vertical orientation, as illustrated in FIG. 11. Edge 94 of pawl 84 engages the inside surface of the web 55 on inner channel 46 to prevent further rotation of pawl 84 on connector pin 48, and retains pawl 84 in a generally vertical orientation. In this orientation, pawl finger 99 is disposed to the right of support pin 75 (as viewed in FIG. 11), and the pocket 100 on the lower end of pawl 84 is aligned vertically with support pin 75.

The shifting of pawl 84 from the caster "off" position illustrated in FIG. 9 to the raised vertical position illustrated in FIG. 11 is communicated to the user by a conspicuous clicking sound, which results from abutment between pawl 84 and inner channel 46 as pawl 84 rotates. Upon perceiving this clicking noise, the user then lowers table 1 until the pocket 100 of pawl 84 engages support pin 75, which contact retains retractable caster 2 in the "on" position. As table 1 is lowered downwardly into the caster "on" position, the side edge 118 of lever 85 is translated alongside ramp 77 to prevent pawl 84 from rotating out of position.

As best illustrated in FIG. 1, when retractable caster 2 is in the "on" position, the feet 4 of table 1 are elevated slightly above the surface of the floor 37, such that glides 5 do not touch the floor when the table is balanced or poised in a generally vertical orientation on caster wheel 40. In the caster "on" position, the weight of table 1, as well as any articles thereon, is transmitted to caster wheel 40 through support pin 75 and pawl 84.

With retractable caster 2 in the "on" position illustrated in FIGS. 1 and 12, the user shifts or balances table 1 so that its center of gravity is disposed substantially directly below caster wheel 40 in a poised condition. Table 1 is then manually pushed or pulled to the desired location, with caster wheel 40 rolling across the floor surface and supporting the weight of table 1. Preferably, table 1 is pulled from one location to another in the slightly inclined orientation illustrated in FIG. 1, wherein the leading feet 4 are elevated above the trailing feet 4. In this position, the glides 5 on the leading feet 4 are less likely to inadvertently engage the floor during transport, which is particularly important when the table is being rolled over deep pile carpeted surfaces, and the like. The radially extending feet 4 provide outrigger support for the table during transport, such that if balance is not properly maintained, table 1 will not tip over, but will merely temporarily assume a slightly laterally inclined position, until it is repositioned in a poised condition over caster wheel 40. Abutment between glides 5 and the floor 37 can create a wobbling type of table translation, which even those of very limited strength and/or dexterity can manage. It is contemplated that under normal circumstances, table legs 25 will be oriented generally diagonally to the direction of motion of table 1, with two of legs 25 on the leading side of pedestal 3, and the other two legs 25 on the trailing side of pedestal 3. However, it is to be understood that so long as table 1 remains poised over caster wheel 40, table 1 can be easily transported, regardless of the orientation of legs 25 to the direction of motion.

Figure 13:
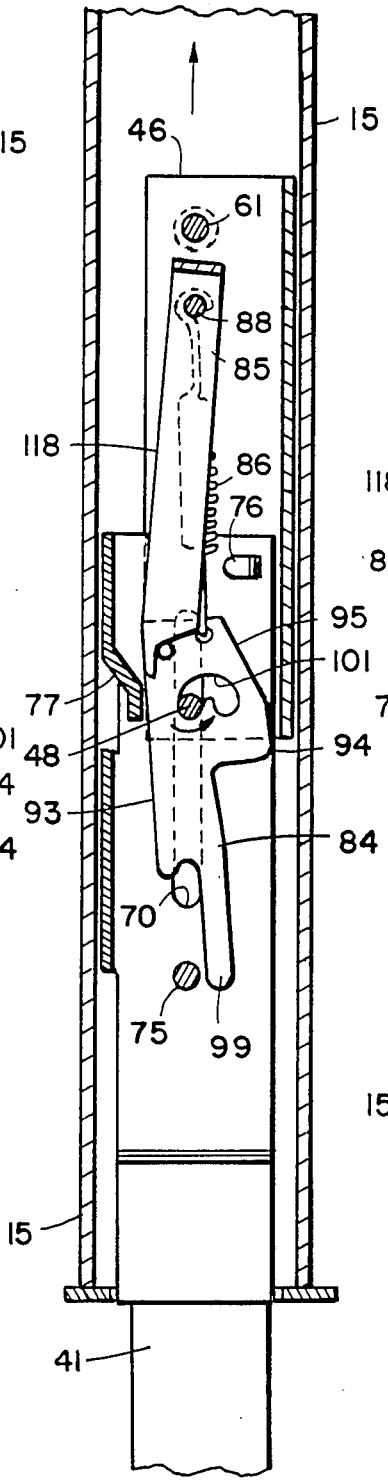
FIG. 13 is a vertical cross-sectional view of the caster actuator, shown in the position assumed when the table is raised partially upwardly from the caster "on" position.
Figure 14:
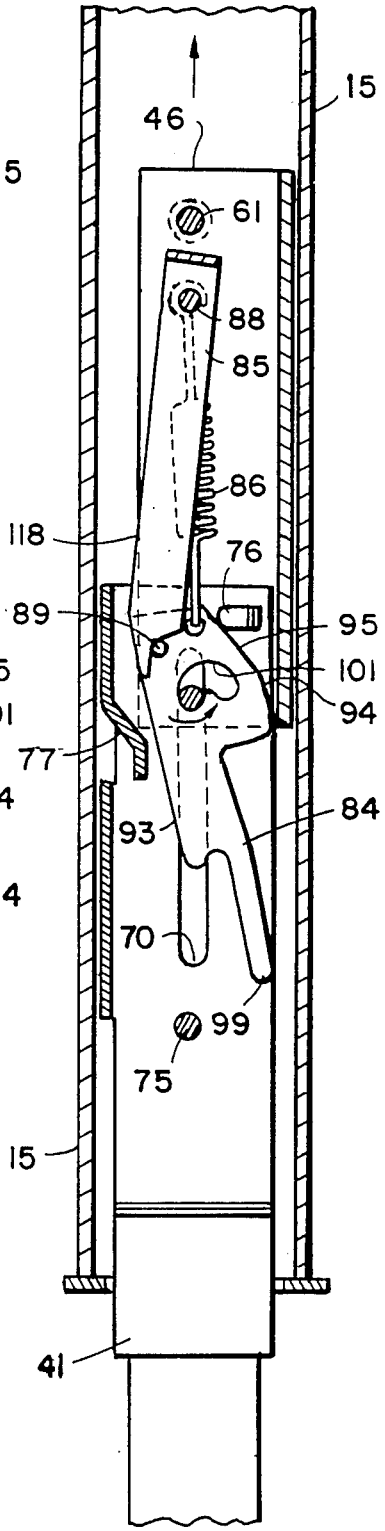
FIG. 14 is a vertical cross-sectional view of the caster actuator, shown in the position assumed when the table is raised further upwardly from the position illustrated in FIG. 13, showing a latch pawl portion of the actuator in a counterclockwise biased position.
Figure 15:
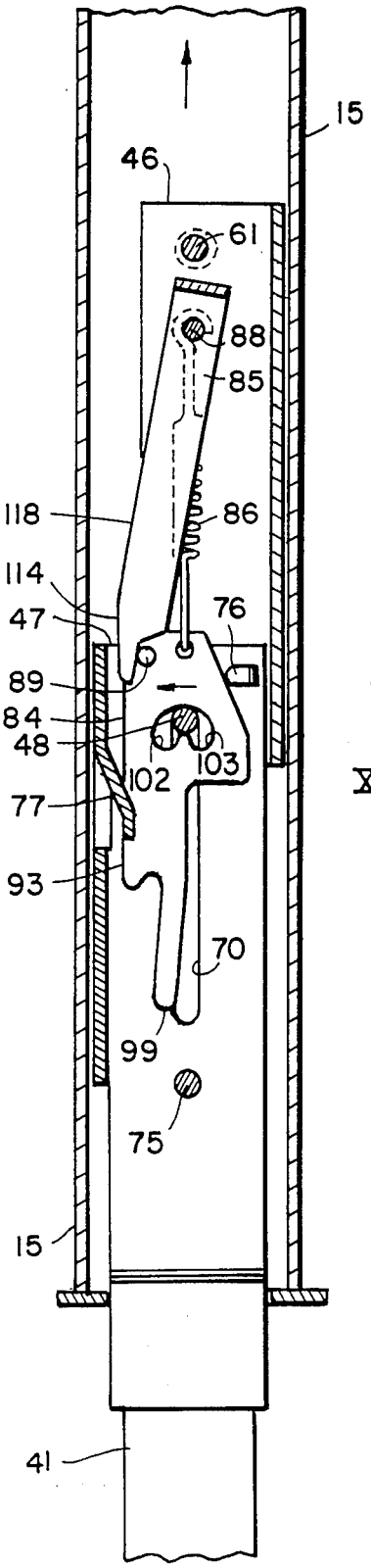
FIG. 15 is a vertical cross-sectional view of the caster actuator, shown in the position assumed when the table is raised further upwardly from the position illustrated in FIG. 14, showing the latch pawl being shifted from the counterclockwise biased position to a clockwise biased position.
Figure 16:
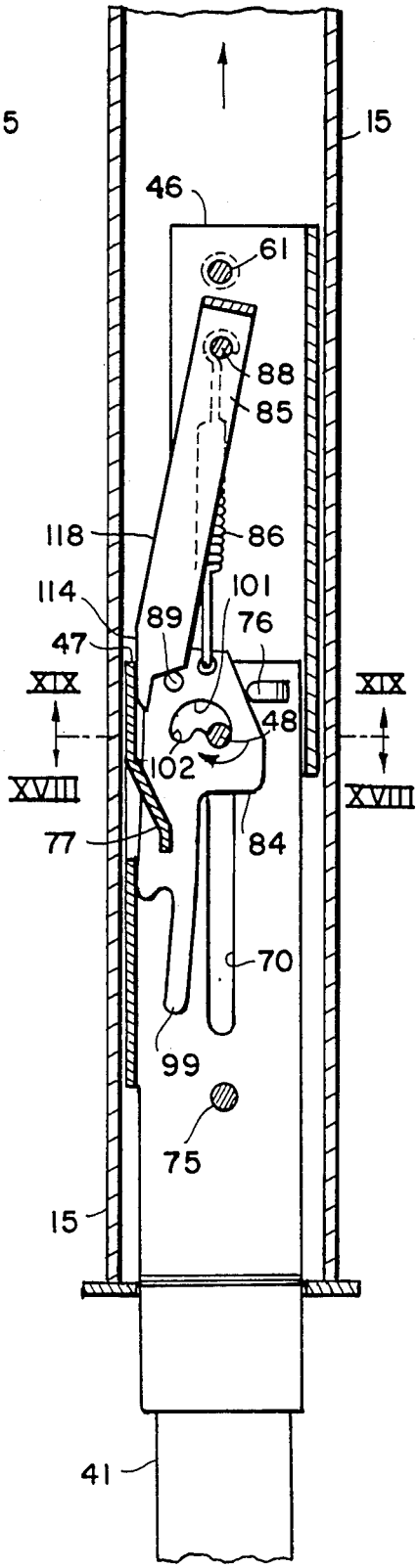
FIG. 16 is a vertical cross-sectional view of the caster actuator, shown raised further upwardly from the position illustrated in FIG. 15 to a fully extended position, with the latch pawl shifted fully into the clockwise biased position.

Once table 1 has been moved to its desired location, retractable caster 2 can be easily shifted to the "off" position in the following manner. The user, grasping the marginal edge 8 of table top 7, again tilts the table slightly on feet 4. Tilting of table 1 on or about two of feet 25, in the manner described above to shift caster wheel 40 into the "on" position, provides maximum stability and ease. This tilting action again raises center column 15, and attached actuator inner channel 46, with respect to floor 37. The initial stage of this lifting action is illustrated in FIG. 13 wherein the side edge 118 of lever 85 has been raised above side ramp 77 to permit pawl 84 to shift and/or rotate. Further upward translation of center column 15 from the position illustrated in FIG. 13 causes the beveled edge 95 of pawl 84 to abut tab 76, as shown in FIG. 14. The contact between tab 76 and the beveled edge 95 of pawl 84 rotates pawl 84 in a counterclockwise direction, and simultaneously pushes or shifts pawl 84 laterally in the direction illustrated by the straight arrow in FIG. 15, which corresponds to the left-hand direction, as oriented in FIGS. 9–22. Because of the inclination of pawl edge 95, contact with tab 76 moves pawl 84 both downwardly and to the left with respect to connector pin 48, thereby disengaging the left-hand pawl socket 102 from connector pin 48. Continued upward translation of center column 15 causes pawl 84 to move fully laterally, with pawl lobe 104 skipping over connector pin 48, so that connector pin 48 is positioned within the right-hand socket 103 of pawl 84, as illustrated in FIG. 16, wherein retractable caster assembly 2 is fully extended In this position, spring 86 exerts a torque on pawl 84, which is directed in a clockwise direction, as illustrated by the curved arrow in FIG. 16. This torque causes pawl 84 to rotate about connector pin 48 from the general vertically orientation illustrated in FIG. 15 to the clockwise pivoted position illustrated in FIG. 16. Continued rotation of pawl 84 is resisted by contact between the side edge 93 of pawl 94, and the inside surface of center column 15. Pawl pin 89 abuts inclined lever edge 115, and retains lever 85 in the angled orientation illustrated in FIG. 16, wherein the lower end of lever 85 abuts intermediate channel 47.

Figure 17:
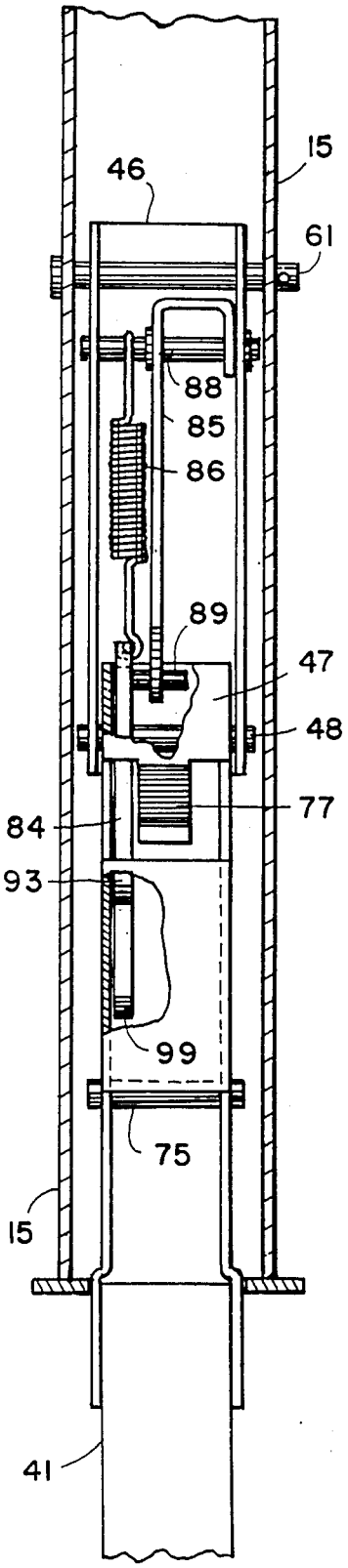
FIG. 17 is a side elevational view of the caster actuator, shown in the fully extended position illustrated in FIG. 16, with portions thereof broken away to reveal internal construction.

Table 1 is then lowered downwardly from the fully extended position shown in FIGS. 16–17 toward the caster "off" position. As pawl finger 99 passes downwardly beyond support pin 75, as illustrated in FIG. 20, the beveled edge 114 of lever 85 engages ramp 77, and rotates lever 85 in a counterclockwise direction. Hence, the inclined camming edge 115 of lever 85 both translates downwardly, and rotates in a counterclockwise direction, which moves pawl pin 89 downwardly and laterally to the right, in the direction illustrated by the straight arrow shown in FIG. 20. Lever 85 thereby imparts both vertical and horizontal movement to pawl 84 to disengage pawl socket 103 from connector pin 48, and clear the same over the lobe portion 104 of pawl 84 Continued lowering of table 1 causes pawl 84 to shift completely to the right, so that connector pin 48 is located in the left-hand socket 102 of pawl 84, as illustrated in FIG. 21. This shifting action causes coil spring 86 to reverse the direction of torque applied to pawl 84, so that pawl 84 rotates in a counterclockwise direction until edge 96 abuts support pin 75. Continued lowering of table 1 places retractable caster 2 back into the "off" position, as illustrated in FIGS. 22 and 9.

It is to be noted that connector pin 48, and the ends of spring 86 are positioned in an over-centered relationship, which causes pawl 84 to automatically shift laterally with a snapping action. This spring action securely retains pawl 84 in the two, laterally shifted positions shown in FIGS. 14 and 16 respectively, and also prevents pawl 84 from becoming stuck in the neutral position shown in FIG. 15.

In one working embodiment of the present invention in the caster "on" position, glides 5 are spaced above the surface of floor 37 a distance of approximately one-half inch when table 1 is centered and poised squarely over caster wheel 40. To shift table 1 from the caster "off" position to the caster "on" position, table 1 is tilted on two adjacent legs of pedestal base 3, until the remaining two legs are raised approximately four inches up off of floor 37. Actuator 45 then shifts automatically and table 1 is then lowered to the caster "on" position To shift table 1 from the caster "on" position to the caster "off" position, table 1 is tilted on two adjacent legs of pedestal base 3, until the remaining two legs are raised approximately six inches up off of floor 37. Actuator 45 then automatically shifts, and table 1 is then lowered to the caster "off" position.

Since the tilting and/or lifting of table 1 is required to shift retractable caster 2 between the "on" and "off" positions, the transport mechanism is very safe, and cannot be inadvertently actuated Furthermore, the operation of retractable caster 2 is such that even if table 1 were lifted up and carried across floor 37 in a conventional fashion by two people, caster wheel 40 will automatically assume the "off" position when table 1 is lowered back onto the floor. Hence, caster wheel 40 cannot be inadvertently shifted to the "on" position.

High-low adjuster 6 is best illustrated in FIGS. 26–32, and provides means by which the top 7 of table 1 can be raised and lowered with respect to pedestal base 3. In the illustrated example, a rigid spider angle 124 fixedly attaches table top 7 to high-low housing 33. However, it is to be understood that a pivot attachment mechanism (not shown) could be used to enable table top 7 to pivot into a substantially vertical orientation on pedestal base 3 to facilitate nested storage, transport through doorways, et cetera, and may even permit removal of table top 7 from base 3.

Figure 26:
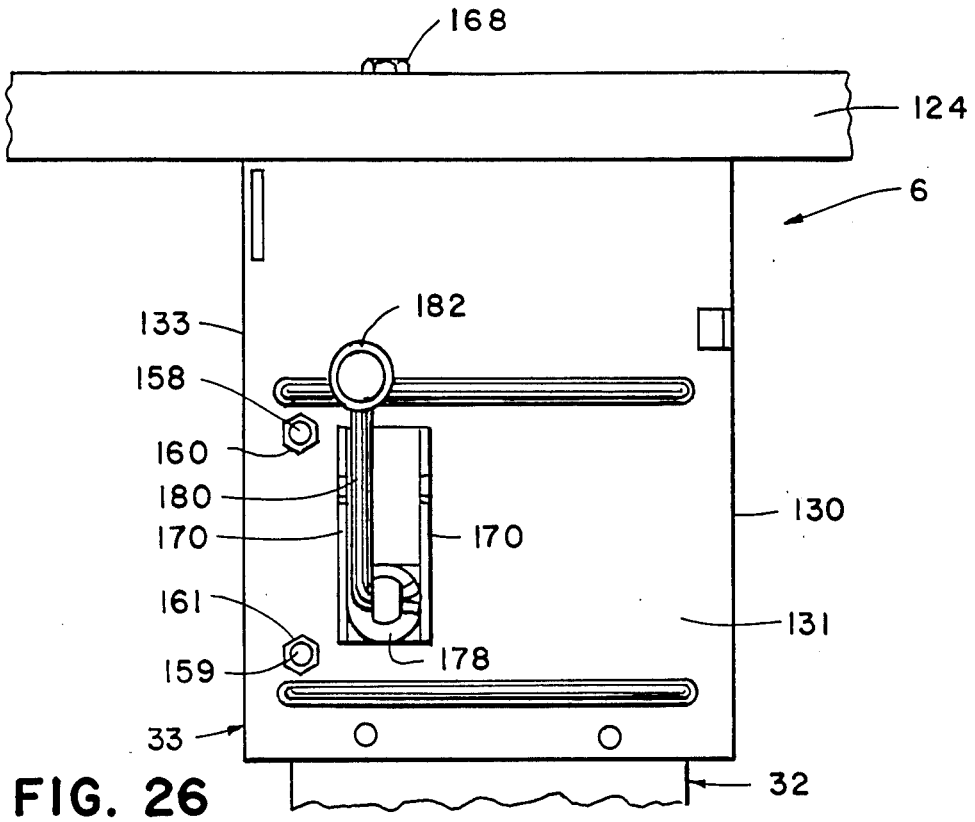
FIG. 26 is a side elevational view of a high-low adjustment mechanism for the table.
Figure 27:
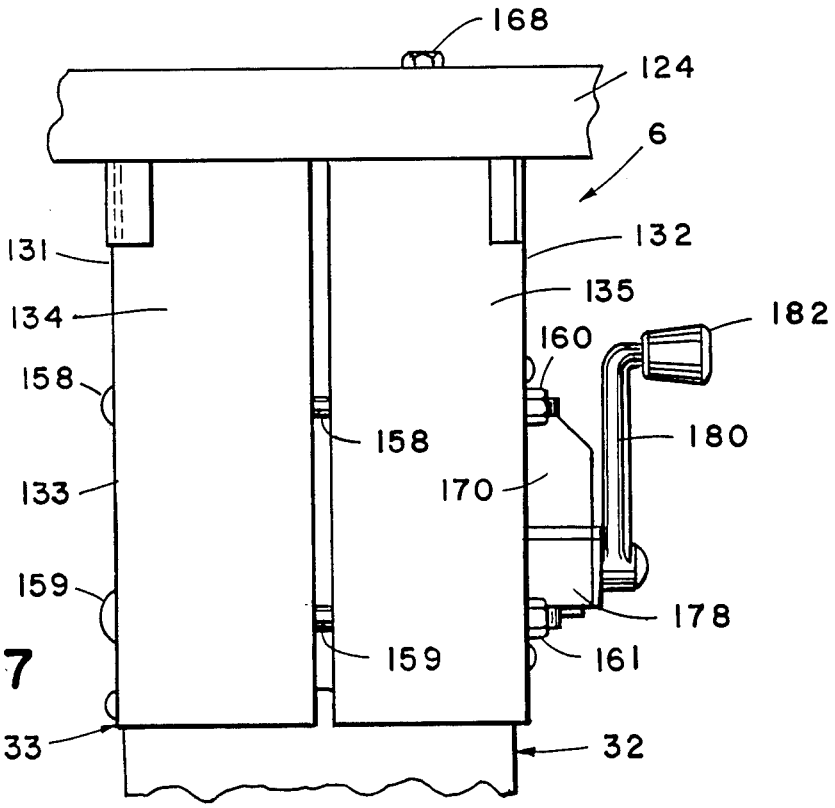
FIG. 27 is a front elevational view of the high-low mechanism.
Figure 31:
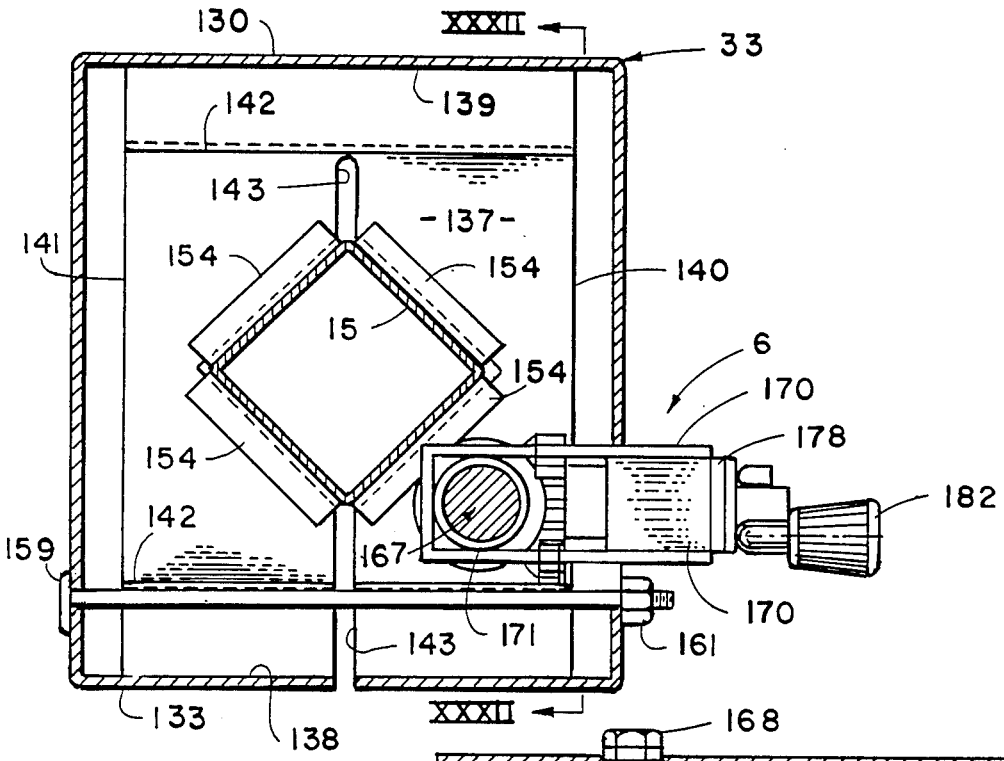
FIG. 31 is a horizontal cross-sectional view of the high-low mechanism, taken along the line XXXI—XXXI of FIG. 30.
Figure 32:
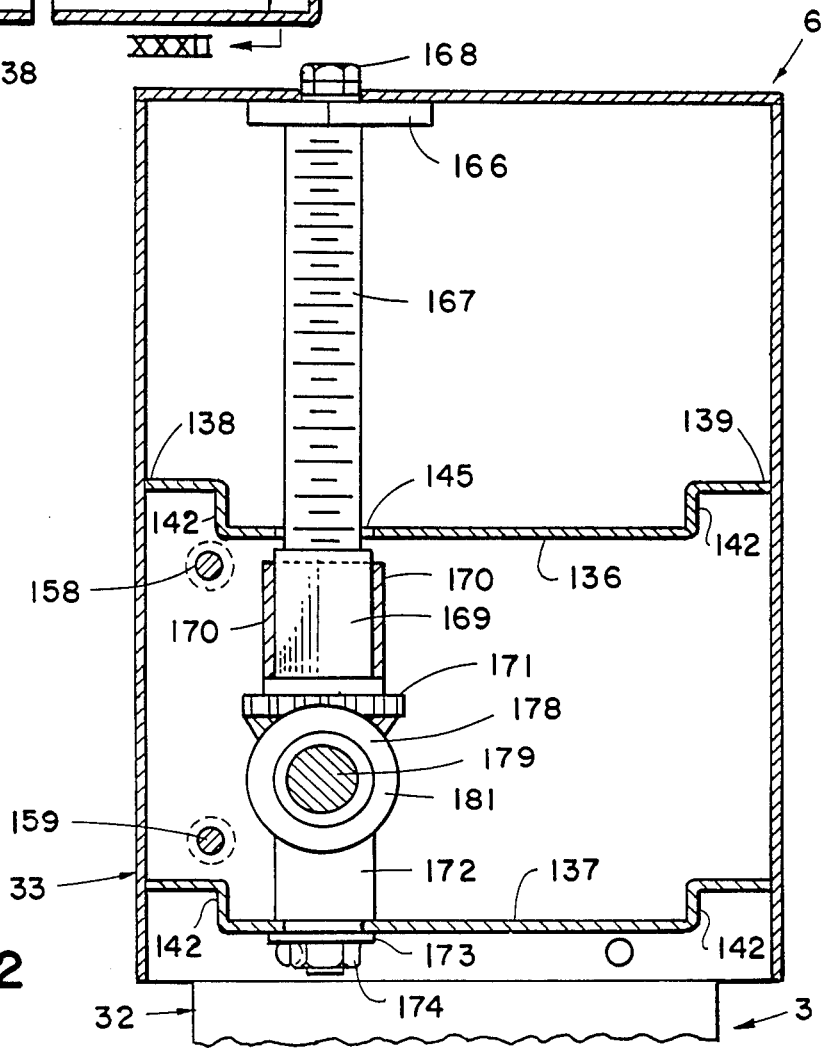
FIG. 32 is a vertical cross-sectional view of the high-low mechanism, taken along the line XXXII—XXXII of FIG. 31.

In the illustrated example, high-low adjuster 6 has a unique split housing construction that simply and economically mounts the table top for smooth vertical adjustment, yet provides extremely stable support. As best illustrated in FIGS. 26 and 27, the housing 33 of high-low adjuster 6 comprises a rear wall 130, opposite sidewalls 131 and 132, and a split front wall 133 having opposite sides 134 and 135 respectively. Housing 33 may also be constructed by using two separate C-shaped halves (not shown), and interconnecting the same along only the rear walls to provide a split front wall. A pair of clamp plates 136 and 137 (FIGS. 31–32) are mounted within housing 33, and include front edges 138, rear edges 139 and side edges 140 and 141. As best illustrated in FIG. 32, clamp plates 136 and 137 each have a generally U-shaped lateral cross-sectional configuration with opposing flanges 142, and are spaced vertically apart in a mutually parallel relationship. Clamp plates 136 and 137 each include a centrally located slot 143 therethrough, which extends from the front edge 138 of the plate, along the longitudinal centerline thereof at a location adjacent to the flange 142 at the rear edge 139 of the plate. The front and rear edges 138 and 139 of both clamp plates 136 and 137 are fixedly attached to the front and rear walls 130 and 133 of housing 33 by fastening means, such as welding or the like.

Clamp plates 136 and 137 (FIGS. 20–30) also each include a central aperture 144 therethrough, having a substantially square shape, and being defined by edges 146–149 respectively Each aperture 144 is oriented so that the associated slot 143 passes through the opposite corners thereof formed at the intersection of edges 149 & 146, and 148 & 147 respectively A plurality of U-shaped glides 154 are mounted on clamp plates 136 and 137, and are adapted to slidingly abut the exterior faces 16–19 of center column 15. Each glide 154 is preferably constructed from an antifriction material, such as nylon or the like, and has a generally U-shaped lateral cross-sectional configuration, comprising a web 155, and opposite flanges 156 and 157. The cavity formed between the web 155 and flanges 156 and 157 of glide 154 defines a groove in which the edges 146–149 of clamp plates 136 and 137 are received, so as to securely mount eight glides 154 thereon. The exterior surface of glide webs 155 contacts the exterior faces 16–19 of center column 15 to securely mount housing 33 on center column 15 for sliding translation up and down center column 15. A pair of carriage bolts 158 and 159 (FIGS. 26 and 27) extend through laterally aligned apertures in housing sidewalls 131 and 132 at the forward portion of housing 33. Hence, bolts 158 and 159 bridge or interconnect the opposite halves 134 and 135 of the split front housing sidewall 133. By tightening nuts 160 and 161 on bolts 158 and 159, the left and right-hand halves 134 and 135 of front housing wall 133 are converged, thereby converging the glides 154 on clamping plate edges 146 and 147 with respect to edges 148 and 149 to eliminate any clearance therebetween, so that housing 33 is snugly mounted on center column 15, yet can slidingly translate up and down along the exterior faces 16–19 thereof. The square shape of center column 15 and mating clamp plate apertures 144 and 145 prevents table top 7 from rotating in a horizontal plane on pedestal base 3. Due to the vertical spacing of clamp plates 136 and 137 in housing 33, the two sets of four glides 154 abut the exterior faces 16–19 of center column 15 at two vertically spaced apart locations, which provides very secure lateral stability for table top 7. This mounting arrangement, along with the clamping action of glides 154 on center column 15, imparts a very solid feel to top 7, which is free of any shake or wobble. This type of stability is particularly important when elderly patients use the marginal edge of the table as a grab bar to assist in entering and exiting their seats, especially if the table is supporting drinks, or other items that can readily spill.

High-low adjuster 6 also includes a crank assembly 165 (FIGS. 28–30) to translate housing 33 up and down along center column 15. Crank assembly 165 includes a rectangular mounting plate 166 fixedly attached to the upper end of center column 15, and extending laterally outwardly therefrom in a cantilevered fashion. A high-low screw 167 is suspended from mounting plate 166, and has its upper end connected therewith by a fastener 168. High-low screw 167 extends vertically downwardly from mounting plate 166 in a direction parallel with center column 15, through vertically aligned apertures 145 in upper and lower clamping plates 136 and 137. A sleeve bearing 169 is rotatably carried on the lower end of high-low screw 167, and is mounted on sidewall 131 of housing 33 by a pair of inverted L-shaped bearing yokes 170. A mitered gear nut 171 is mounted on high-low screw 167 directly below bearing 169, and includes an interior thread that mates with high-low screw 167, such that rotation of mitered gear nut 171 about high-low screw 167 raises and lowers housing 33 on center column 15. A spacer sleeve 172 is mounted on high-low screw 167 directly below mitered gear nut 171, and a washer 173 and nut 174 are mounted on the terminal, lower end of high-low screw 163 to act as a stop for housing 33. The aperture 145 in upper and lower clamp plates 136 and 137 have a diameter sized slightly larger than the outside diameter of high-low screw 167, so that as housing 33 is lifted upwardly along center column 15, clamp plates 136 and 137 slide over the outside surface of screw 167. Clamp plates 136 and 137 thereby provide lateral stability for screw 167. The lower clamp plate 137 also supports spacer 172, such that as mitered gear nut 171 advances upwardly on screw 167, spacer 172 follows along on the screw.

A crank sleeve 178 is mounted between bearing yokes 170 on the exterior side of housing sidewall 131. A drive shaft 179 is rotatably mounted in crank sleeve 178, and a crank 180 is connected with the outer end of drive shaft 179, and a mitered gear 181 is connected with the interior end of drive shaft 179. Mitered gear 181 is shaped and positioned to mate with mitered gear nut 171, such that rotation of crank 180 rotates mitered gear nut 171, thereby vertically translating housing 33 along center column 15 to adjust the height of table top 7. A knob 182 is pivotally mounted on the free end of crank 180 to facilitate manual rotation of crank 180. Furthermore, indicator indicia (not shown) is preferably disposed on the top 7 of table 1 to indicate the location of crank 180 to facilitate quickly locating and grasping crank 180.

Figure 23:
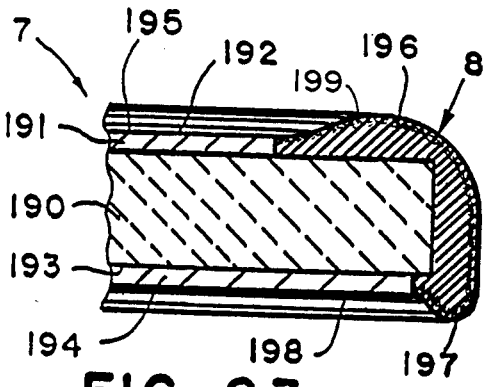
FIG. 23 is a fragmentary, vertical cross-sectional view of a top portion of the table.

With reference to FIG. 23, the illustrated table top 7 comprises a rigid, planar core panel 190, having the upper surface covered by a coating or layer 192 of maintenance free, laminate material, such as plastic, fiberglass or the like, and preferably has a non-glare gelcoat finish. The lower surface 193 of core panel 190 is also covered by a coating or layer 194 of substantially imperforate material, so that the entire table top 7 can be thoroughly cleaned and sanitized. Top 7 may have a variety of different plan configurations, such as square, rectangular, etc., as well as the circular shape illustrated in the drawings. The marginal edge 8 of top 7 is molded integrally with laminate layers 192 an 194, and is raised above the upper surface 195 of upper laminate layer 192 to provide a spill guard for liquids Marginal edge 8 also has a gently rounded, generally arcuate surface 196 that alleviates excessive pressure on the forearms of users, and also is readily adapted for grasping to facilitate entering and exiting seats disposed adjacent to table 1. The lower portion 197 of marginal edge 8 is generally concave, and includes a downwardly extending ridge or rim 198 which, in conjunction with the raised and rounded upper surface 196, forms a continuous, circular handle about the entire periphery of table top 7 that is readily adapted for grasping to facilitate tilting table 1 to shift retractable caster 2 between the "on" and "off" positions, and manually translating the table from one location to another in a poised condition over caster wheel 40. The marginal edge portion 8 of table top 7 preferably carries pigmentation or coloration 199 that contrasts with the color of upper laminate layer 192 to facilitate use by visually impaired users. The color contrast assists visually impaired users in accurately ascertaining the location of the edge of the table, so that inadvertent spills can be alleviated, and the user can use the edge of the table as a grasping bar to safely enter and exit his seat.

Retractable caster assembly 2 permits a person of ordinary strength and dexterity to easily and safely move table 1 from one location to another without assistance. Retractable caster assembly 2 can be shifted between the "on" and "off" positions from a fully erect position or upright posture by simply tilting the table 1 on feet 4, thereby avoiding any bending or stooping. Since retractable caster assembly 2 is mounted wholly within center pedestal 3, it does not in any way interfere with clearance underneath the table, or obstruct freedom of movement of the user's legs, and also provides table 1 with a neat, sleek appearance With retractable caster 2 in the "on" position, table 1 can be easily rolled from one location to another by simply placing the table in a poised condition over caster wheel 40, and pulling the table over the floor. The height of table top 2 can be readily adjusted to accommodate wheelchairs and the like by simply rotating crank 180. The raised and rounded edge 8 of table top 7 not only provides a spill guard, but greatly facilitates use by visually impaired users.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention to which an exclusive property or privilege is claimed are defined as follows:

1.

A portable table, comprising:

a top shaped to selectively support articles thereon;

a base having an upper end thereof operably connected with said top, and being adapted to selectively support said top on a support surface at a preselected height; said table having a center o gravity below which at least a portion of said base is positioned to selectively support said table in stationary positions on the support surface;

a retractable caster, including a ground engaging wheel with means for shifting said caster wheel between an extended position wherein said caster wheel is weight-bearing and supports said table on the support surface, and a retracted position wherein said caster wheel is not weight-bearing, and said base supports said table on the support surface; said retractable caster being connected with said table at a location selected so that said caster wheel is disposed substantially directly below the center of gravity of said table when said caster wheel is in the extended position, whereby said table can be easily transported from one location to another by shifting said caster wheel to the extended position, positioning said table in a generally poised condition over said caster wheel, and manually translating said table in the generally poised condition over the support surface.

2. A table as set forth in claim 1, wherein:

said base includes at least three glide surfaces, which are disposed in a radially outwardly, circumferentially spaced apart relationship, and are elevated slightly above the support surface when said caster wheel is in the extended position with said table poised thereover to provide outrigger support for said table during transport.

3. A table as set forth in claim 2, wherein:

said means for shifting said caster wheel includes means for automatically shifting said caster wheel between the extended and retracted positions by selectively raising and lowering said base.

4. A table as set forth in claim 3, wherein:

said base is shaped to permit said table to tilt slightly on the support surface in response to force applied to said top; and said caster wheel shifting means is actuated by tilting said table.

5. A table as set forth in claim 4, wherein:

said table top includes a peripheral edge shaped for grasping to facilitate manually tilting said table to shift said caster wheel, positioning said table in the poised condition, and translating said table over the support surface.

6. A table as set forth in claim 5, wherein:

said caster wheel swivels about a generally vertically oriented axis to facilitate translation of said table in different directions.

7. A table as set forth in claim 6, wherein said base includes a central pedestal having at least three feet extending radially outwardly therefrom in a circumferentially spaced apart pattern.

8. A table as set forth in claim 7, wherein said feet include outer ends; and said glide surfaces are located on said feet adjacent the outer ends thereof.

9. A table as set forth in claim 8, wherein said retractable caster is mounted inside said central pedestal.

10. A table as set forth in claim 9, wherein:

said retractable caster includes a central axis extending generally vertically from a central portion of said caster wheel;

said table includes a vertically disposed central axis which extends through the center of gravity of said table; and said retractable caster is positioned so that when said caster wheel is in the extended position, the central axis of said table is generally coincident with the central axis of said retractable caster.

11. A table as set forth in claim 10, wherein:

said means for shifting said caster wheel comprises:

an intermediate channel operably connected with said caster wheel;

an inner channel operably connected with said central pedestal;

means for slidably interconnecting said intermediate channel and said inner channel for selected longitudinal translation therebetween; and a latch pawl assembly mounted in said intermediate channel, and selectively engaging said inner channel in an engaged position to releasably retain said caster wheel in said extended position.

12. A table as set forth in claim 11, wherein said latch pawl assembly comprises:

a latch pawl having a heart-shaped aperture disposed therein;

a connecting pin mounted in said inner channel and extending through said heart-shaped aperture to rotatably mount said latch pawl in said inner channel; and a tab disposed on said intermediate channel and positioned to selectively abut said latch pawl during relative movement between said inner channel and said intermediate channel to shift said latch pawl into the engaged position.

13. A table as set forth in claim 12, including:

means for vertically adjusting the position of said top on said central pedestal.

14. A table as set forth in claim 13, wherein:

said top comprises a rigid panel having an upper surface with a preselected coloration to abuttingly support articles thereon, and a marginal edge which is raised above the level of said support surface to form a spill guard, and has a coloration contrasting to the coloration of said upper surface to facilitate use by visually impaired users.

15. A table as set forth in claim 14, wherein:

said top marginal edge is rounded t alleviate pressure on the arms of the users.

16. A table as set forth in claim 15, wherein:

said top marginal edge includes a concave lower surface to facilitate grasping the same.

17. A table as set forth in claim 1, wherein:

said means for shifting said caster wheel includes means for automatically shifting said caster wheel between the extended and retracted positions by selectively raising and lowering said base.

18. A table as set forth in claim 1, wherein:

said base is shaped to permit said table to tilt slightly on the support surface in response to force applied to said top; and said caster wheel shifting means is actuated by tilting said table.

19. A table as set forth in claim 1, wherein:

said caster wheel swivels about a generally vertically oriented axis to facilitate translation of said table in different directions.

20. A table as set forth in claim 1, wherein:

said base includes at least three feet extending radially outwardly from said pedestal in a circumferentially spaced apart pattern.

21. A table as set forth in claim 1, wherein:

said base includes a central pedestal; and said retractable caster is mounted inside said central pedestal.

22. A table as set forth in claim 1, wherein:

said retractable caster includes a central axis extending generally vertically from a central portion of said caster wheel;

said table includes a vertically disposed central axis which extends through the center of gravity of said table; and said retractable caster is positioned so that when said caster wheel is in the extended position, the central axis of said table is generally coincident with the central axis of said retractable caster.

23. A table as set forth in claim 1, wherein:

said top comprises a rigid panel having an upper surface with a preselected coloration to abuttingly support articles thereon, and a marginal edge which is raised above the level of said support surface to form a spill guard, and has a coloration contrasting to the coloration of said upper surface to facilitate use by visually impaired users.

24. A portable table, comprising:

a top shaped to selectively support articles thereon;

a base having an upper end thereof operably connected with said top, and being adapted to selectively support said top on a support surface at a preselected height; said table having a center of gravity below which at least a portion of said base is positioned to selectively support said table in stationary positions on the support surface;

a retractable glide, having a ground engaging glide surface adapted for supporting said table for movement over the support surface, and including means for shifting said glide surface between an extended position wherein said glide surface is weight-bearing and supports said table on the support surface, and a retracted position wherein said glide surface is not weight-bearing, and said base supports said table on the support surface; said retractable glide being connected with said table at a location selected so that said glide surface is disposed substantially directly below the center of gravity of said table when said glide surface is in the extended position, whereby said table can be easily transported from one location to another by shifting said glide surface to the extended position, positioning said table in a generally poised condition over said glide surface, and manually translating said table in the generally poised condition over the support surface.

25. A table, comprising:

a top shaped to selectively support articles thereon;

a pedestal having upper and lower ends, and being adapted to support said top above a support surface;

a base operably connected with the lower end of said pedestal, and abuttingly supporting said table on the support surface;

a collar operably connected with said top, and slidingly supported on said pedestal for vertical movement therealong;

screw and nut means on said pedestal and said collar for raising and lowering said top with respect to said base; and clamping means on said collar and engaging said pedestal for clamping said collar onto said pedestal to provide lateral stability to said top with respect to said pedestal and said base.

26. A table, comprising:

a top shaped to selectively support articles thereon;

a pedestal having upper and lower ends, and being adapted to support said top above a support surface;

a base operably connected with the lower end of said pedestal, and abuttingly supporting said table on the support surface;

a collar operably connected with said top, and slidingly supported on said pedestal for vertical movement therealong;

a screw having an upper end thereof connected with said pedestal, and extending generally parallel therewith;

a nut carried on said collar, and threadedly engaging said screw, whereby selective rotation of said nut with respect to said screw raises and lowers said top and wherein said pedestal includes a smooth exterior surface; and said collar includes at least one clamp plate fixed thereto having an aperture therethrough defined by at least one peripheral edge shaped to closely receive said pedestal therein, and at least one glide mounted on said peripheral edge for sliding contact with the exterior surface of said pedestal, said clamping plate clamping said glide against said exterior surface of said pedestal.

27. A table as set forth in claim 26, including:

a slot extending from one edge of said clamp plate through said peripheral edge to define opposite sides of said clamp plate with free ends; and means for converging and diverging the opposite sides of said clamp plate to snugly retain said glide on the exterior surface of said pedestal.

28. A table as set forth in claim 27, wherein:

said glide includes first and second separate segments positioned on the opposite sides of said clamp plate.

29. A table as set forth in claim 28, including:

a second clamp plate substantially similar to said first-named clamp plate, mounted in said collar, and positioned in a vertically spaced apart relationship with said first-named clamp plate to provide lateral stability to said top.

30. A table as set forth in claim 29, wherein:

said pedestal has a generally square lateral cross-sectional shape, with first, second, third and fourth oppositely oriented substantially planar, exterior surfaces.

31. A table as set forth in claim 30, wherein:

said aperture of both of said first and second-named clamp plates has a generally square plan shape defined by four peripheral edges with corners therebetween.

32. A table as set forth in claim 31, wherein:

said slot of both of said first-named and second-named clamp plates extends through opposite corners of said clamp plate aperture.

33. A table set forth in claim 32, including:

a crank rotatably mounted on an exterior surface of said collar and operably connected with said nut to transmit rotational motion therebetween.

34. A table as set forth in claim 33, including:

mating bevel gears mounted to transmit rotational motion from said crank to said nut to raise and lower said top.

* * * * *